United States Patent [19]

Yamanouchi et al.

[11] Patent Number: 4,874,689

[45] Date of Patent: Oct. 17, 1989

[54] SILVER HALIDE COLOR PHOTOGRAPHIC MATERIAL

[75] Inventors: Junichi Yamanouchi; Shigetoshi Ono; Tsumoru Hirano; Toshiyuki Watanabe; Nobuo Sakai; Keiji Mihayashi, Minami-Ashigara, all of Japan

[73] Assignee: Fuji Photo Film Co., Ltd., Kanagawa, Japan

[21] Appl. No.: 52,881

[22] Filed: May 22, 1987

[30] Foreign Application Priority Data

May 24, 1986 [JP] Japan ..... 61-119902

[51] Int. Cl.[4] ..... G03C 7/32

[52] U.S. Cl. ..... 430/548; 430/552; 430/553; 430/554; 430/555; 430/556; 430/557; 430/558

[58] Field of Search ..... 430/548, 553, 555, 557, 430/558, 552, 554, 556

[56] References Cited

U.S. PATENT DOCUMENTS

| | | | |
|---|---|---|---|
| 2,671,021 | 3/1954 | Kleiger et al. | 430/548 |
| 4,080,211 | 3/1978 | Van Paesschen et al. | 430/548 |
| 4,487,855 | 12/1984 | Shih et al. | 525/330.7 |
| 4,612,278 | 9/1986 | Lau et al. | 430/548 |
| 4,663,272 | 5/1987 | Nakamura | 430/548 |
| 4,668,613 | 5/1987 | Yagihara et al. | 430/548 |

*Primary Examiner*—Paul R. Michl
*Assistant Examiner*—Mark R. Buscher
*Attorney, Agent, or Firm*—Birch, Steward, Kolasch & Birch

[57] ABSTRACT

A silver halide color photographic material containing new dye image-forming couplers consisting of polymer couplers obtained by a polymerization reaction which employs a chain transfer agent having 8 or more carbon atoms. The silver halide color photographic material exhibits a high sensitivity and a high color-forming property.

19 Claims, No Drawings

SILVER HALIDE COLOR PHOTOGRAPHIC MATERIAL

BACKGROUND OF THE INVENTION (1) Field of the Invention

The present invention relates to a silver halide photographic material containing new dye image-forming couplers capable of coupling with the oxidation product of an aromatic primary amine developing agent.

(2) Description of the Prior Art

It is known that when a silver halide photographic material undergoes color development after exposure, the oxidation product of an aromatic primary amine developing agent reacts with couplers to form indophenol, indoaniline, indamine, azomethine, phenoxazine, phenazine, and other similar dyes, thereby forming color images. In this system, the color reproduction is usually accomplished by a substractive color process which employs silver halide emulsions selectively sensitive to blue, green, and red and dye image forming agents for yellow, magenta, and cyan which are complementary to the three colors respectively.

In the case of a multilayer color photographic material, it is necessary to fix the respective couplers in discrete layers so that color mixing is reduced and the color reproduction is improved. There are many known methods for rendering the couplers nondiffusible. According to one of the methods, a long-chain aliphatic group is introduced into a low-molecular weight coupler for the prevention of diffusion. The coupler produced by this method is not miscible with an aqueous solution of gelatin; therefore, it has to be solubilized in an alkali prior to being added to a gelatin solution, or it has to be dissolved in a high-boiling organic solvent for emulsification and dispersion into an aqueous solution of gelatin. A color coupler as the one described above, has the disadvantage of causing crystals to separate out in the emulsion. When a high-boiling organic solvent is used, it is necessary to employ a large amount of gelatin because the solvent softens the emulsion layer. This conflicts with the desire to reduce the thickness of the emulsion layers.

Another method of introducing couplers into discrete layers is to use a latex of a polymer coupler obtained by the polymerization of a monomer coupler. Adding a polymer coupler in latex form to a hydrophilic colloid composition has many advantages over other methods. First of all, the latex containing a hydrophobic material does not impair the strength of the film formed. In the second place, the latex containing a coupler in high concentrations permits the emulsion to contain couplers in high concentrations. In the third place, the emulsion layer can be made thin because the latex only minimally increases the viscosity of the emulsion. This thin layer contributes to an improved sharpness. Lastly, being non-migratory, the latex does not bring about color mixing, nor does it cause the coupler to separate out in the emulsion layer.

As for the polymer coupler in latex form to be added to the gelatin-silver halide emulsion, there are processes disclosed for the production and a four-equivalent magenta polymer coupler latex, for example, in U.S. Pat. Nos. 4,080,211 and 3,451,820. In British Pat. No. 1,247,668, there is disclosed a latex of a copolymer of a coupler with a competing coupler in West German Pat. No. 2,725,591 and U.S. Pat. No. 3,926,436. Further, in U.S. Pat. No. 3,767,412 and Research Disclosure 21728 (1982) there is disclosed a cyan polymer coupler latex.

In spite of the above-mentioned outstanding features, the polymer coupler still has the following problems to be solved.

(1) The polymer coupler having a comparatively high molecular weight (greater than about 10,000 in number-average molecular weight) is satisfactory in non-migratory properties; but it is poor in coupling reactivity and hence it produces a dye which is low in sensitivity, gradation, and density.

(2) When the polymer coupler contains the coupler units (the recurring units having the coupler residue) in high concentration, it extremely decreased in color-forming property per unit weight (of the coupler units).

(3) The polymer coupler of low molecular weight produces a dye of high density but is unsatisfactory in non-migratory properties. For this reason, it causes color mixing and it decreases the sensitivity.

If a polymer coupler containing the coupler units in high concentrations is capable of maintaining a color-forming property, it would only be necessary to add a small amount of coupler in high concentrations to the emulsion. This would make it possible to reduce the thickness of the sensitive layer and to considerably improve the sharpness of the image. Therefore, it is important to improve the color-forming property of a polymer coupler containing coupler units in high concentrations. It is also important to reconcile the non-migratory properties and coupling reactivity of a polymer coupler.

BRIEF SUMMARY OF THE INVENTION

Accordingly, it is a first object of the present invention to provide a silver halide color photographic material having a high sensitivity.

It is a second object of the present invention to provide a new coupler which has a high sensitivity and an outstanding color-forming property.

It is a third object of the present invention to provide a new coupler which contains coupler units in high concentrations and which exhibits a high color-forming property.

It is a fourth object of the present invention to provide a silver halide color photographic material which is not subject to color mixing because of the non-migratory property of the coupler.

It is a fifth object of the present invention to provide a process for forming a color image by developing a silver halide emulsion in the presence of a dispersion of the new coupler.

It is a sixth object of the present invention to provide a silver halide color photographic material containing a latex of the new coupler, a method for processing the photographic material, and a method for forming an image processing the photographic material.

The objects of the present invention are achieved by a silver halide color photographic material which comprises lipophilic polymer couplers obtained by a polymerization reaction which employs a chain transfer agent having 8 or more carbon atoms.

Other and further objects, features and advantages of the present invention will appear more fully from the following description.

DETAILED DESCRIPTION OF THE INVENTION

The lipophilic polymer coupler used in the present invention is produced by a polymerization reaction which employs a chain-transfer agent having 8 or more carbon atoms. It is a mixture of polymers of varied structures, and most of these polymers are represented by general formula [P] given below.

$$E\text{-}(A)_x(B)_y\text{-}X \qquad [P]$$

wherein E represents a monovalent group having 8 or more carbon atoms; A represents a recurring unit derived from an ethylenic unsaturated monomer having a coupler residue capable of forming a dye through coupling with the oxidation product of an aromatic primary amine developing agent; B represents a non-dye forming recurring unit derived from an ethylenic unsaturated monomer capable of being copolymerized; X represents a monovalent group; and x and y each represent the content of the respective recurring units in the polymer coupler, the ratio (x:y) by weight being 10:90 to 100:0.

As described below, the compound represented by general formula [P] is explained in more detail.

As mentioned above, A represents a recurring unit having a coupler residue capable of forming a dye through coupling with the oxidation product of an aromatic primary amine developing agent. It is derived from a monomer represented by general formula [I] presented below

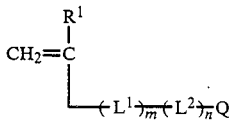

[I]

wherein $R^1$ represents a hydrogen atom, an alkyl group having 1–4 carbon atoms, or a chlorine atom; $L^1$ represents

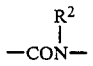

wherein $R^2$ represents a hydrogen atom, an alkyl group having 1–4 carbon atoms, or a substituted alkyl group having 1–6 carbon atoms, —COO—, —NHCO—, —OCO—,

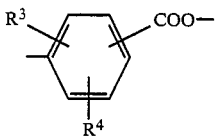

wherein $R^3$ and $R^4$ independently represent a hydrogen atom, hydroxyl group, halogen atom, or substituted or unsubstituted, alkyl group, alkoxy group, acyloxy group, or aryloxy group (hereinafter and in claims simply referred to as alkyl, alkoxy, acyloxy or arylcxy group),

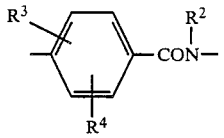

wherein $R^2$, $R^3$, and $R^4$ are as defined above; $L^2$ represents linking groups to connect $L^1$ with Q; m represents a numeral of 0 or 1 and n represents a numeral of 0 or 1; and Q represents a coupler residue capable of forming a dye through coupling with the oxidation product of an aromatic primary amine developing agent.

The linking group, $L^2$, is represented in a concrete form by the following formula $$\text{-}(X^1\text{-}(J^1-X^2)_p(J^2-X^3)_q(J^3)_r)_s$$

wherein $J^1$, $J^2$, and $J^3$, which may be the same or different, each represents

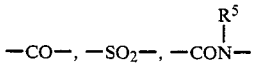

($R^5$ represents a hydrogen atom, alkyl group (having 1–6 carbon atoms), substituted alkyl group (having 1–6 carbon atoms),

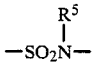

($R^5$ is as defined above),

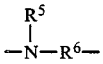

($R^5$ is as defined above, and $R^6$ represents an alkylene group having 1 to about 4 carbon atoms),

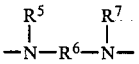

($R^5$ and $R^6$ are as defined above, and $R^7$ represents a hydrogen atom, alkyl group (having 1–6 carbon atoms), or substituted alkyl group (having 1–6 carbon atoms)),

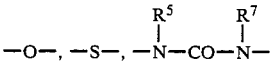

($R^5$ and $R^7$ are as defined above),

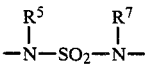

($R^5$ and $R^7$ are as defined above), —COO—, —OCO—,

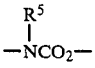

($R^5$ is as defined above), and

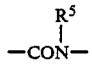

($R^5$ is as defined above;

$X^1$, $X^2$, and $X^3$, which may be the same or different, each represent an alkylene group, substituted alkylene group, arylene group, substituted arylene group, aralkylene group, or substituted aralkylene group; and p, q, r, and s each represent 0 or 1.

$X^1$, $X^2$, and $X^3$ in general formula [I], which may be the same or different from one another, represent unsubstituted or substituted alkylene groups, aralkylene groups, or phenylene groups having 1-10 carbon atoms. The alkylene group may be of straight chain or branched chain. Examples of the alkylene group include methylene, methylmethylene, dimethylmethylene, dimethylene, trimethylene, tetramethylene, pentamethylene, hexamthylene, and decylmethylene, Examples of the aralkylene group include benzilidene. Examples of the phenylene group include p-phenylene, m-phenylene, and methylphenylene.

The substituent groups which may be introduced in the alkylene group aralkylene group, or phenylene group represented by $X^1$, $X^2$, and $X^3$ include, for example, a halogen atom, nitro group, cyano group, alkyl group, substituted alkyl group, alkoxyl group, substituted alkoxyl group, —$NHCOR^8$ ($R^8$ represents an alkyl group, substituted aralkyl group, phenyl group, substituted phenyl group, aralkyl group, or substituted aralkyl group), —$NHSO_2R^8$ ($R^8$ is as defined above, —$SOR^8$ ($R^8$ is as defined above), —$SO_2R^8$ ($R^8$ as defined above), —$COR^8$ ($R^8$ is as defined above),

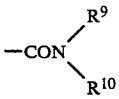

($R^9$ and $R^{10}$, which may be the same or different, each represent a hydrogen atom, alkyl group, substituted aralkyl group, phenyl group, substituted phenyl group, aralkyl group, or substituted aralkyl group),

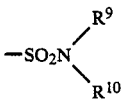

($R^9$ and $R^{10}$ are as defined above), amino group which may be substituted with an alkyl group, hydroxyl group, and any group which forms a hydroxyl group upon hydrolysis. When there are two or more substituent groups, they may be the same or different from one another.

The substituent group which may be introduced in the above-mentioned substituted alkyl group, substituted alkoxyl group, substituted phenyl group and substituted aralkyl group includes, for example, a hydroxyl group, nitro group, alkoxyl group having 1 to about 4 carbon atoms, —$NHSO_2R^8$ ($R^8$ is as defined above), —$NHCOR^8$($R^8$ is as defined above),

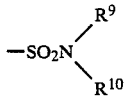

($R^9$ and $R^{10}$ are as defined above),

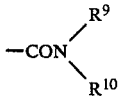

($R^9$ and $R^{10}$ are as defined above), —$SO_2R^8$ ($R^8$ is as defined above, —$COR^8$ ($R^8$ is as defined above), halogen atom, cyano group, and amino group which may be substituted with an alkyl group.

The color coupler residues represented by Q in the above-mentioned general formula [I] contain a cyan-forming coupler residue derived from a phenol compound or naphthol compound represented by general formula [II], [XXV] or general formula [III] or [IV], respectively, presented below. (it connects to $\text{-}(L^1)_m\text{-}(L^2)_n\text{-}$ through elimination of a hydrogen atom other than that in the hydroxyl group.)

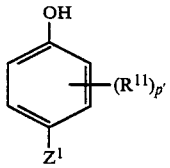

[II]

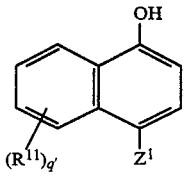

[III]

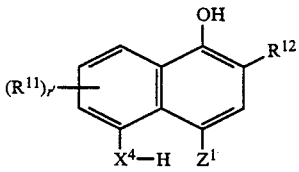

[IV]

or

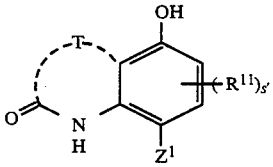

[XXV]

In the above formulas [II], [III], [IV] and [XXV];

$R^{11}$ represents a possible substituent group on the phenol ring or naphthol ring. It includes, for example, a halogen atom, hydroxyl group, amino group, carboxyl group, sulfo group, cyano group, aliphatic group, aromatic group, heterocyclic group, carbonamido group, sulfonamido group, carbamoyl group, sulfamoyl group, ureido group, acyloxy group, acyl group, aliphatic oxy group, aliphatic thio group, aliphatic sulfonyl group, aromatic oxy group, aromatic thio group, aromatic sulfonyl group, sulfamoyl amino group, nitro group, and imido group. $R^{11}$ has 0 to 30 carbon atoms.

$R^{12}$ represents $—CONR^{14}R^{15}$, $—NHCOR^{14}$, $—NHCOOR^{16}$, $—NHSO_2R^{16}$, $—NHCONR^{14}R^{15}$, or $—NHSO_2R^{14}R^{15}$. $R^{14}$ and $R^{15}$ each represent a hydrogen atom, aliphatic group having 1–30 carbon atoms (e.g., methyl group, ethyl group, butyl group, methoxyethyl group, n-decyl group, n-dodecyl group, n-hexadecyl group, trifluoromethyl group, heptafluoropropyl group, dodecyloxypropyl group, 2,4-di-tert-amylphenoxypropyl group, and 2,4-di-tert-amylphenoxybutyl group), aromatic group having 6–30 carbon atoms (e.g., phenyl group, tolyl group, 2-tetradecyloxyphenyl group, pentafluorophenyl group, and 2-chloro-5-dodecyloxycarbonylphenyl group), or heterocyclic group having 2–30 carbon groups (e.g., 2-pyridyl group, 4-pyridyl group, 2-furyl group, and 2-thienyl group). $R^{16}$ represents an aliphatic group having 1–30 carbon atoms (e.g., methyl group, ethyl group, dodecyl group, and hexadecyl group), aromatic group having 6–30 carbon atoms (e.g., phenyl group, tolyl group, 4-chlorophenyl group, and naphthyl group), or heterocyclic group (e.g., 4-pyridyl group, quionlyl group, and 2-furyl group). $R^{14}$ and $R^{15}$ may join each other to form a heterocyclic ring (e.g., morpholine ring, piperidine ring, and pyrrolidine ring). p′ represents an integer of 0 to 3, s′ represents an integer of 0 to 2, and q′ and r′ each represent an integer of 0 to 4.

$X^4$ represents an oxygen atom, sulfur atom, or $R^{17}N<$. $R^{17}$ represents a hydrogen atom or monovalent group. When $R^{17}$ represents a monovalent group, it includes, for example, an aliphatic group having 1–30 carbon atoms (e.g., methyl group, ethyl group, butyl group, methoxyethyl group, and benzyl group), aromatic group having 6–30 carbon atoms (e.g., phenyl group and tolyl group), heterocyclic group having 2–30 carbon atoms (e. g., 2-pyridyl group and 2-pyrimidyl group), carbonamido group having 1–30 carbon atoms (e.g., formamido group, acetamido group, N-methylacetamido group, and benzamido group), sulfonamido group having 1–30 carbon atoms (e.g., methanesulfonamido group, toluenesulfonamido group, and 4-chlorobenzenesulfonamido group), imido group having 4–30 carbon atoms (e.g., succinimido), $—OR^{18}$, $—SR^{18}$, $—COR^{18}$, $—CONR^{18}R^{19}$, $—COCOR^{18}$, $—COCONR^{18}R^{19}$, $—COOR^{20}$, $—COCOOR^{20}$, $—SO_2R^{20}$, $—SO_2OR^{20}$, $—SO_2NR^{18}R^{19}$, or $—NR^{18}R^{19}$. $R^{18}$ and $R^{19}$, which may be the same or different, each represent a hydrogen atom, aliphatic group having 1–30 carbon atoms (e.g., methyl group, ethyl group, butyl group, dodecyl group, methoxyethyl group, trifluoromethyl group, and heptafluoropropyl group), aromatic group having 6–30 carbon atoms (e.g., phenyl group, tolyl group, 4-chlorophenyl group, pentafluorophenyl group, 4-cyanophenyl group, and 4-hydroxphenyl group), or heterocyclic ring having 2–30 carbon atoms (e.g., 4pyridyl group, 3-pyridyl group, and 2-furyl group). $R^{18}$ and $R^{19}$ may join each other to form a heterocyclic ring (e.g., morpholino group and piperidino group).

$R^{20}$ includes, for example, those substituents groups (excluding a hydrogen atom) exemplified for $R^{18}$ and $R^{19}$.

$Z^1$ represents a hydrogen atom or a group capable of splitting-off upon coupling reaction with the oxidation product of an aromatic primary amine developing agent. Examples of the group capable of splitting-off include a halogen atom (e.g., fluorine atom, chlorine atom, bromine atom, and iodine atom), aliphatic oxy group having 1–30 carbon atoms (e.g., methoxy group, ethoxy group, 2hydroxyethoxy group, carboxymetyhyloxy group, 3-carboxypropyloxy group, 2-methoxyethoxycarbamoylmethyloxy group, 2-methanesulfonylethoxy group, 2-carboxymethylthioethoxy group, and triazolylmethyloxy group), aromatic oxy group having 6 to 30 carbon atoms (e.g., phenoxy group, 4-hydroxyphenoxy group, 2-acetamidophenoxy group, 2,4-dibenzenesulfonamidophenoxy group, and 4-phenylazophenoxy group), heterocyclic oxy group having 2–30 carbon atoms (e.g., 4-pyridyloxy group and 1-phenyl-5-tetrazolyloxy group, aliphatic thio group having 1–30 carbon atoms (e.g., dodecylthio group), aromatic thio group having 6–30 carbon atoms (e.g., 4dodecyl-phenylthio group), heterocyclicthio group having 2–30 carbon atoms (e.g., 4pyridylthio group and 1phenyltetrazol-5-yl-thio group), acyloxy group having 2–30 carbon atoms (e.g., acetoxy group, benzoyloxy group, and lauroyloxy group), carbonamido group having 1–30 carbon atoms (e.g., dichloroacetylamido group, trifluoroacetamido group, heptafluorobutanamido group, and pentafluorobenzamido group), sulfonamido group having 1–30 carbon atoms (e.g., methanesulfonamido group and toluenesulfonamido group), aromatic azo group having 6–30 carbon atoms (e.g., phenylazo group, 4-chlorphenylazo group, 4-methoxyphenylazo group, and 4-pivaloylaminophenylazo group), aliphatic oxycarbonyloxy group having 1–30 carbon atoms (e.g., ethoxycarbvonyloxy group and dodecyloxycarbonyloxy group), aromatic oxycarbonyloxy group having 6–30 carbon atom (e.g., phenoxycarbonyloxy group), carbamoyloxy group having 1–30 carbon atoms (e.g., methylcarbamoyloxy group, dodecylcarbamoyloxy group, and phenylcarbamoyloxy group), and heterocyclic group having 1–30 carbon atoms and connecting to the active site of the coupler through a nitrogen atom (e.g., succinimido group, phthalimido group, hydantoinyl group, pirazolyl group, and 2-benzotriazolyl group).

T represents a group of atoms required to form a 5-, 6- or 7-membered ring by connecting with the carbon atoms. It represents, for example $$—O—,\ —\underset{R''}{\underset{|}{N}}—,\ —\underset{O}{\underset{\|}{C}}—,\ —S—,\ —N=,\ =N—,\ —\underset{R''}{\underset{|}{C}}=,$$

$$=\underset{R''}{\underset{|}{C}}—\ \text{or}\ —\overset{R''}{\overset{|}{\underset{R'''}{\underset{|}{C}}}}—$$

or a combination thereof. In the formulas, R″ and R‴ each represent a hydrogen atom, alkyl group, aryl group, halogen atom, alkyloxy group, alkyloxycarbonyl group, arylcarbonyl group, alkylcarbamoyl group, arylcarbamoyl group or cyano group.

The preferred substituent groups in the present invention are exemplified in the following.

$R^{11}$ includes a halogen atom (e.g., fluorine atom, chlorine atom, and bromine atom), aliphatic group (e.g., methyl group, ethyl group, and isopropyl group), carbonamido group (e.g., acetamido group and benzamido group), sulfonamido group (e.g., methanesulfonamido group and toluenesulfonamido group).

$R^{12}$ includes $—CONR^{14}R^{15}$ (e.g., carbamoyl group, ethylacarbamoyl group, morpholinocarbonyul group, dodecylcarbamoyl group, hexadecylcarbamoyl group, decyloxypropyl group, dodecyloxypropyl group, 2,4-di-tert-amylphenoxypropyl group, and 2,4-di-tert-amylphenoxybutyl group).

$X^4$ includes $R^{17}N<$, wherein $R^{17}$ is preferably —$COR^{18}$ (e.g., formyl group, acetyl group, trifluoroacetyl group, chloroacetyl group, benzoyl group, pentafluorobenzoyl group, and p-chlorobenzoyl group), —$COOR^{20}$ (e.g., methoxycarbonyl group, ethoxycarbonyl group, butoxycarbonyl group, dodecyloxycarbonyl group, methoxyethoxycarbonyl group, and phenoxycarbonyl group), —$SO_2R^{20}$ (e.g., methanesulfonyl group, ethanesulfonyl group, butanesulfonyl group, nexadecanesulfonyl group, benzenesulfonyl group, toluenesulfonyl group, and p-chlorobenzensulfonyl group), —$CONR^{18}R^{19}$ (e.g., N,N-dimethylcarbamoyl group, N,N-diethylcarbamoyl group, N,N-dibutylcarbamoyl group morpholinocarbonyl group, piperidinocarbonyl group, 4-cyanophenylcarbamoyl group, 3,4-dichlorophenylcarbamoyl group, and 4-methanesulfonyl-phenylcarbamoyl group), and —$SO_2NR^{18}R^{19}$ (e.g., N,N-dimethylsulfamoyl group, N,N-diethylsulfamoyl group, and N,N-dipropylsulfamoyl group). Particularly preferred examples of $R^{17}$ are those groups represented by —$COR^{18}$, —$COOR^{20}$, and —$SO_2R^{20}$.

$Z^1$ includes a hydrogen atom, halogen atom, aliphatic oxy group, aromatic oxy group, heterocyclic thio group, and aromatic azo group.

The coupler represented by the general formula may be a dimer or polymer formed by the union of monomers through a divalent or polyvalent linking group at the substituent group $R^{11}$, $R^{12}$, $X^4$, or $Z^1$. In such a case, the number of carbon atoms shown for the above-mentioned substituent groups is not applicable.

The magenta-forming coupler residue is one which is represented by general formula [V], [VI], [VII], [VIII], [IX], [X], or [XI] given below. (The coupler residue connects to $\text{-}(L^1)_m\text{-}(L^2)_n\text{-}$ at any of Ar, $Z^2$, and $R^{21}$ to $R^{33}$. In general formula [V], the coupler residue should preferably connect directly to the substitution position or $R^{21}$.)

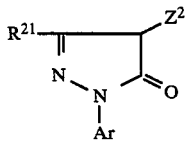

(V)

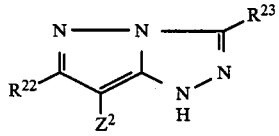

(VI)

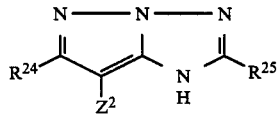

(VII)

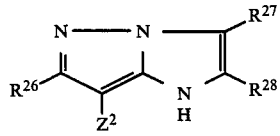

(VIII)

-continued

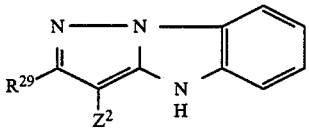

(IX)

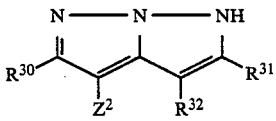

(X)

or

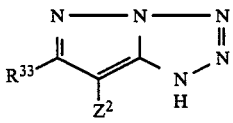

(XI)

In the formulae, Ar represents a substituent group of well-known type at 1-position of 2-pirazolin-5-on coupler. Examples of the substituent group include an alkyl group, substituted alkyl group (e.g., haloalkyl such as fluoroalkyl, cyanoalkyl, and benzylalkyl), aryl group or substituted aryl group [the substituent group is an alkyl group (e.g., methyl group and ethyl group), alkoxyl group (e.g., methoxy group and ethoxy group), aryloxy group (e.g., phenyloxy group), alkoxycarbonyl group (e.g., methoxycarbonyl group), acylamino group (e.g., acetylamino group), carbamoyl group, alkylcarbamoyl group (e.g., methyl carbamoyl group and ethylcarbamoyl group), dialkylcarbamoyl group (e.g., dimethylcarbamoyl group), arylcarbamoyl group (e.g., phenylcarbamoyl group), alkylsulfonylgroup (e.g., methylsulfonyl group), arylsulfonyl group (e.g., phenylsulfonyl group), alkylsulfonamido group (e.g., methanesulfonamido group), arylsulfonamido (e.g., phenylsulfonamido group), sulfamoyl group, alkylsulfamoyl group (e.g., ethylsulfamoyl group), dialkylsulfamoyl group (e.g., dimethylsulfamoyl group), alkylthio group (e.g., methylthio group), arylthio group (e.g., phenylthio group), cyano group, nitro group, or halogen atom (e.g., fluorine, chlorine, and bromine). When there are two or more substituent groups, they may be the same or different. A particularly preferred substituent group is a halogen atom, alkyl group, alkoxyl group, alkoxycarbonyl group, and cyano group.], and heterocyclic group (e.g., triazole, thiazole, benzthiazole, furan, pyridine, quinaldine, benzoxazole, pyrimidine, oxazole, and imidazole).

$R^{21}$ represents and unsubstituted or substituted anilino group, acylamino group (e.g., alkylcarbonamido group, phenylcarbonamido group, alkoxycarbonamido group, and phenyloxycarbonamido group) or ureido group (e.g., alkylureido group and phenylureido group). Examples of the substituent group which may be introduced in these groups include a halogen atom (e.g., fluorine atom, chlorine atom, and bromine atom), straight chain or branched chain alkyl group (e.g., methyl group, t-butyl group, octyl group, and tetradecyl group), alkoxyl group (e.g., methoxy group, ethoxy group, 2-ethylhexyloxy group, and tetradecyloxy group), acylamino group (e.g., acetamido group, benzamido group, butanamido group, octanamido group, and tetradecanamido group), α-(2,4-di-tert-amylphenoxy) acetamido group, α-(2,4-di-tert-amylphenoxy) butylamido group, α-(3-pentadecylphenoxy) hexanamido group, α-(4-hydroxy-3-tert-butylphenoxy) tetradecanamido group, 2-oxo-piridin-1-yl group, 2-oxo-5-tetradecylpyrolidin-1-yl group, and N-methyl-tetradecanamido group), sulfonamido group (e.g., methanesulfonamido group, benzenesulfonamido group, ethylsulfonamido group, p-toluenesulfonamido group, octanesulfonamido group, p-dodecylbenzenesulfonamido group, and N-methyl-tetradecanesulfonamido group), sulfamoyl group (e.g., sulfamoyl group, N-methylsulfamoyl group, N-ethylsulfamoyl group, N,N-dimethylsulfamoyl group, N,N-dihexylsulfamoyl group, N-hexadecylsulfamoyl group, N-[3-(dodecyloxy)-propyl] sulfamoyl group, N-[4-(2,4-di-tert-amylphenoxy) butyl] sulfamoyl group, and N-methyl-N-tetradecylsulfamoyl group), carbamoyl group (e.g., N-methylcarbamoyl group, N-butylcarbamoyl group, N-octadecylcarbamoyl group, N-[4-(2,4-di-tert-amylphenoxy) butyl]-carbamoyl group, and N-methyl-N-tetradecylcarbamoyl group), diacylamino group (N-succinimido group, N-phthalimido group, 2,5-dioxo-1-oxazolidinyl group, 3-dodecyl-2,5-dioxo-1-hydantoinyl group, and 3-(N-acetyl-N-dodecylamino) succiniimido group), alkoxycarbonyl group (e.g., methoxycarbonyl group, tetradecyloxycarbonyl group, and benzyloxycarbonyl group), alkoxysulfonyl group (e.g., methoxysulfonyl group, butoxysulfonyl group, octyloxysulfonyl group, and tetradecyloxysulfonyl group), aryloxysulfonyl group (e.g., phenoxysulfonyl group, p-methylphenoxysulfonyl group, and 2,4-di-tert-amylphenoxysulfonyl group), alkanesulfonyl group (e.g., methanesulfonyl group, ethanesulfonyl group, octanesulfonyl group, 2-ethylhexylsulfonyl group, and hexadecanesulfonyl group), arylsulfonyl group (e.g., benzenesulfonyl group and 4-nonylbenzenesulfonyl group), alkylthio group (e.g., methylthio group, ethylthio group, hexylthio group, benzylthio group, tetradecylthio group, and 2-(2,4-di-tert-amylphenoxy) ethylthio group), arylthio group (e.g., phenylthio group and p-tolylthio group), alkyloxycarbonylamino group (e.g., methoxycarbonylamino group, ethyloxycarbonylamino group, benzyloxycarbonylamino group, and hexadecyloxycarbonylamino group), alkylureido group (e.g., N-methylureido group, N,N-dimethylureido group, N-methyl-N-dodecylureido group, N-hexadecylureido group, and N,N-dioctadecylureido group), acyl group (e.g., acetyl group, benzoyl group, octadecanoyl group, and p-dodecanamidobenzoyl group), nitro group, carboxyl group, sulfo group, hydroxyl group, and trichloromethyl group.

In the above-mentioned substituent groups, the alkyl groups are those which have 1 to 36 carbon atoms and the arlyl groups are those which have 6 to 38 carbon atoms.

$R^{22}$, $R^{23}$, $R^{24}$, $R^{25}$, $R^{26}$, $R^{27}$, $R^{28}$, $R^{29}$, $R^{30}$, $R^{31}$, $R^{32}$, and $R^{33}$ each represent a hydrogen atom, hydroxyl group, unsubstituted or substituted alkyl group (preferably one having 1–20 carbon atoms, such as methyl group, propyl group, t-butyl group, trifluoromethyl group, and tridecyl group), aryl group (preferably one having 6–20 carbon atoms, such as phenyl group, 4-t-butylphenyl group, 2,4-di-t-amylphenyl group, and 4-methoxyphenyl group), heterocyclic group (e.g., 2-furyl group, 2-thienyl group, 2-pyrimidinyl group, and 2-benzothiazolyl group), alkylamino group (preferably one having 1–20 carbon atoms, such as methylamino group, diethylamino group, and t-butylamino group), acylamino group (preferably one having 2–20 carbon atoms, such as acetylamino group, propylamide group, and benzamido group), anilino group (e.g., phenylamino group and 2-chloroanilino group), alkoxycarbonyl group (preferably one having 2–20 carbon atoms, such as methoxycarbonyl group, butoxycarbonyl group, and 2-ethylhexyloxycarbonyl group), alkycarbonyl group (preferably one having 2–20 carbon atoms, such as acetyl group, butylcarbonly group, and cyclohexylcarbonyl group), arylcarbonyl group (preferably one having 7–20 carbon atoms, such as benzoyl group and 4-t-butylbenzolyl group), alkylthio group (preferably one having 1–20 carbon atoms, such as methylthio group, octylthio group, and 2-phenoxyethylthio group), arylthio group (preferably one having 6–20 carbon atoms, such as phenylthio group and 2-butoxy-5-t-octylphenylthio group), carbamoyl group (preferably one having 1–20 carbon atoms, such as N-ethylcarbamoyl group, N,N-dibutylcarbamoyl group, N,N-dibutylcarbamoyl group, and N-methyl-N-butylcarbamoyl group), sulfamoyl group (preferably one having up to 20 carbon atoms, such as N-ethylsulfamoyl group, and N,N-diethylsulfamoyl group, N,N-dipropylsulfamoyl group), or sulfonamido group (preferably one having 1–20 carbon atoms, such as methanesulfonamido group, benzenesulfonamido group, and p-toluenesulfonamido group).

$Z^2$ represents a hydrogen atom or a group capable of splitting-off upon coupling reaction with the oxidation product of an aromatic primary amine developing agent. The group capable of splitting-off includes a halogen atom (e.g., chlorine atom and bromine atom), a coupling split-off group connected through an oxygen atom (e.g., acetoxy group, propanoyloxy group, benzoyloxy group, ethoxyoxaloyloxy group, pyruvinyloxy group, cinnamoyloxy group, phenoxy group, 4-cyanophenoxyl group, 4-methanesulfonamidophenoxy group, α-naphthoxy group, 4-cyanoxy group, 4-ethanesulfonamidophenoxy group, α-naphthoxy group, 3-pentadecylphenoxy group, benzyloxycarbonyloxy group, ethoxy group, 2-cyanoethoxy group, benzyloxy group, 2-phentyloxy group, 2-phenoxyethoxy group, 5-phenyltertrazolyloxy group, and 2-benzothiazolyloxy group), a coupling split-off group connected through a nitrogen atom (one which is described in Japanese patent application (OPI) No. 99437/1984, such as benzenesulfonamido group, N-ethyltoluenesulfonamido group, heptafluorobutanamido group, 2,3,4,5,6-pentafluorobenzamido group, octanesulfonamido group, p-cyanophenylureido group, N,N-diethylsulfamoylamino group. 1-piperidyl group, 5,5-dimethyl-2,4-dioxo-3-oxazodinyl group, 1-benzyl-5-ethoxy-3-hydantoinyl group, 2-oxo-1,2-dithydro-1-piridinyl group, imidazolyl group, pyrazolyl group, 3,5-diethyl-1,2,4-triazol-1-yl group, 5- or 6-bromobenzotriazol-1 group, 5-methyl-1,2,3,4-triazol-1-yl group, and benzimidazolyl group), and a coupling split-off group connected through a sulfur atom (e.g., phenylthio group, 2-carboxyphenylthio group, 2-methoxy-5-octylphenylthio group, 4-methanesulfonylphenylthio group, 4-octanesulfonamidophenylthio group, benzylthio group, 2-cyanoethylthio group, 5-phenyl-2,3,4,5-tetrazolythio group, and 2-benzothiazolyl group). Preferable among those groups capable of being splitting-off are a halogen atom, a coupling split-off group connected through an oxygen atom, and a coupling split-off group connected through a nitrogen atom. Most preferable among them are an aryloxy group, chlorine atom, pyrazolyl group, imidazolyl group, and triazolyl group.

The yellow-forming coupler residue is of acylacetanilide type, preferably that of pivaloylacetanilide type and benzoylacetanilide type represented by general formula [XII] and [XIII] or [XIV], respectively, given below. (In the general formula, it is connected to $\text{-}(L^1)_m\text{-}(L^2)_n$ at the free bond.)

(XII)

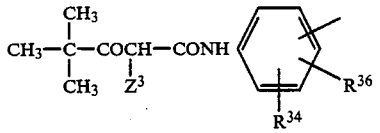

(XIII)

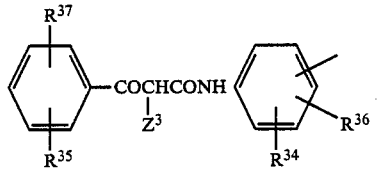

or (XIV)

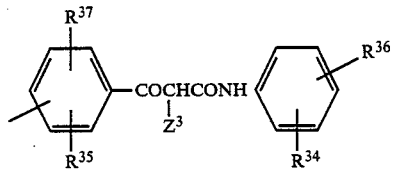

In the formula, $R^{34}$, $R^{35}$, $R^{36}$, and $R^{37}$ each represent a hydrogen atom or a well-known substituent group of the yellow-forming coupler residue, such as alkyl group, alkenyl group, alkoxyl group, alkoxycarbonyl group, halogen atom, alkoxycarbamoyl group, aliphatic amido group, alkylsufamoyl group, alkylsulfonamido group, alkylureido group, alkyl-substituted succinimido group, aryloxy group, aryloxycarbonyl group, arylcarbamoyl group, arylamido group, arylsulfamoyl group, arylsulfonamido group, arylureido group, carboxyl group, sulfo group, nitro group, cyano group, and thiocyano group. These substituent groups may be the same or different.

$Z^3$ is a hydrogen atom or a group represented by general formula [XV], [XVI], [XVII], or [XVIII] given below.

[XV]

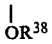

wherein $R^{38}$ is an aryl group or heterocyclic group which may have a substituent group.

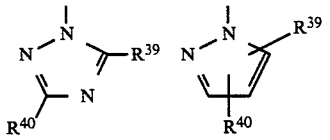

[XVI] [XVII]

wherein $R^{39}$ and $R^{40}$, which are the same or different, each represent a hydrogen atom, halogen atom, carboxylic ester group, amino group, alkyl group, alkylthio group, alkoxyl group, alkylsulfonyl group, alkylsulfinyl group, carboxylic acid group, sulfonic acid group, unsubstituted or substituted phenyl group, or heterocyclic group.

[XVIII]

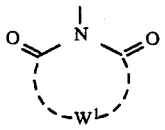

wherein $W^1$ represents a non-metallic atom required to form a 4-, 5-, or 6-membered ring in conjunction with

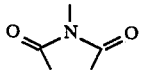

in the general formula.

Preferable among the compounds represented by general formula [XVIII] are those represented by general formulas [XIX] to [XXI] given below.

[XIX]

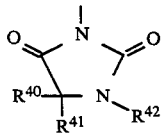

[XX]

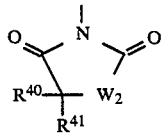

[XXI]

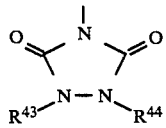

In the formulas, $R^{41}$ and $R^{42}$ each represent a hydrogen atom, alkyl group, aryl group, alkoxyl group, aryloxy group, and hydroxyl group; $R^{43}$, $R^{44}$, and $R^{45}$ each represent a hydrogen atom, alkyl group, aryl group, aralkyl group, or acyl group; and $W^2$ represents an oxygen atom or sulfur atom.

Preferred examples of the ethylenic unsaturated monomer to give the recurring unit represented by B include acrylic acid, α-chloroacrylic acid, α-alkylacrylic acid (e.g., methacrylic acid), esters or amides derived from these acrylic acids (e.g, acrylamide, methacryamide, n-butylacrylamide, t-butylacrylamide, diacetoneacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl mdethacrylate, n-butyl methacrylate, cyclohexyl methacrylate, 2-hydroxyethyl acrylate, 2-hydroxyethyl methacrylate, 2-methoxyethyl acrylate, 2-methoxyethyl methacrylate, 2-ethoxyethyl acrylate, 2-ethoxyethyl methacrylate, 2-butoxyethyl acrylate, 2-n-propyloxethyl methacrylate, and 2-(2-methoxy) ethoxyethyl acrylate), vinyl esters (e.g., vinyl acetate and vinyl laurate), acrylonitrile, methacrylonitrile, dienes (e.g., butadiene and isoprene), aromatic vinyl compounds (e.g., styrene and derivatives thereof, e.g., vinyltoluene, vinylacetophenone, and sulfostyrene), itaconic acid. citraconic acid, crotonic acid, vinylidene chloride, vinyl alkyl either (e.g., vinyl ethyl ether), maleic anhydride, maleic ester, N-vinyl-2-pyrrolidone, N-vinylpyridine, 2-and 4-vinylpyridine, ethylene, propylene, 1-butene, and isobutene. They are not limitative.

These ethylenic unsaturated monomers may be used in combination with one another. For example, ethyl acrylate may be combined with n-butyl acrylate, n-butyl acrylate may be combined with styrene, and methyl methacrylate may be combined with diacetone acrylamide.

Particularly preferable among the compounds represented by general formula [I] are those in which $R^1$ is a hydrogen atom or methyl group; $L^1$ is —CONH—, —COO—,

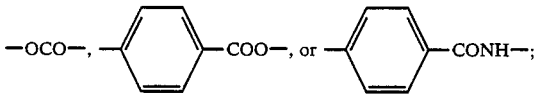

m is 1; n is 0 or 1; $L^2$ is $[X^1-(J^1-X^2)_p(J^2-X^3)_q(J^3)_r]_s$ wherein $J^1$, $J^2$, and $J^3$, which may be the same or different, each represent —CO—, —$SO_2$—, —COHN—, —$SO_2$NH—, —NHCO—, —$NHSO_2$—, —O—, —NHCONH—, —S—, —COO—, —OCO—, —NHCOO—, and —OCONH—; $X^1$, $X^2$, and $X^3$, which may be the same or different, each represent an alkylene group (having 1–4 carbon atoms), arylene group, and substituted arylene group;; and p, q, r, and s each represent 0 or 1).

Most preferable among those represented by A re acrylic esters, methacrylic esters, maleic esters, and styrenes.

In the above-mentioned general formula [P], E represents a monovalent group having 8 or more carbon atoms. Examples of such a group are represented by general formula [XXII] presented below.

$E^1(Y)_r$ [XXII]

wherein $E^1$ represents an alkyl group, substituted alkyl group, substituted aryl group, and substituted naphthyl group having 8 or more carbon atoms.

These groups may further have a substituent group such as a halogen atom, cyano group, alkyl group, substituted alkyl group, alkoxyl group, substituted alkoxyl group, —$NHCOR^{46}$ ($R^{46}$ represents an alkyl group, substituted alkyl group, phenyl group, substituted phenyl group, and aralkyl group), —$NHSO_2R^{46}$($R^{46}$ is as defined above), —$COOR^{46}$ ($R^{46}$ is as defined above), —$OCOR^{46}$ ($R^{46}$ is as defined above), —$SOR^{46}$ ($R^{46}$ is as defined above),

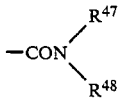

($R^{47}$ and $R^{48}$, which may be the same or different, each represent a hydrogen atom, alkyl group, substituted alkyl group, phenyl group, substituted phenyl group, aralkyl group, and substituted aralkyl group),

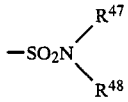

($R^{47}$ and $R^{48}$ are as defined above), amino group which may be substituted by an alkyl group, and hydroxyl group or a group which forms a hydroxyl group upon hydrolysis.

Examples of the substituent groups which may further be introduced in the above-mentioned alkyl group, substituted alkoxyl group, substituted phenyl group, and substituted aralkyl group include a hydroxyl group, alkoxyl group having 1 to about 4 carbon atoms, —$NHSO_2R^{46}$ ($R^{46}$ is as defined above), —$NHCOR^{46}$ ($R^{46}$ is as defined above), —$COOR^{46}$ ($R^{46}$ is as defined above), —$OCOR^{46}$ ($R^{46}$ is as defined above),

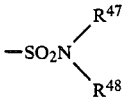

($R^{47}$ and $R^{48}$ are as defined above),

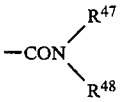

($R^{47}$ and $R^{48}$ are as defined above), —$SO_2R^{46}$ ($R^{46}$ is as defined above), —$COR^{46}$ ($R^{46}$ is as defined above), halogen atom, cyano group, and amino group which may be substituted by an alkyl group.

Preferred examples of $E^1$ are shown in the following though not limitative.

$C_{18}H_{17}$—, $C_{10}H_{21}$—, $C_{12}H_{25}$—, $C_{14}H_{29}$—, $C_{15}H_{31}$—, $C_{16}H_{33}$—, $C_{18}H_{37}$—, $C_{20}H_{41}$—, $C_{31}H_{63}$—, $C_8H_{17}O\underset{\underset{O}{\|}}{C}CH_2$—, $C_{12}H_{25}O\underset{\underset{O}{\|}}{C}CH_2$—

$C_{18}H_{37}O\underset{\underset{O}{\|}}{C}CH_2$—, $C_2H_5O\underset{\underset{O}{\|}}{C}CHC_{12}H_{25}$ $C_{12}H_{25}O\underset{\underset{O}{\|}}{C}CH_2CH_2$—, $C_{18}H_{37}O\underset{\underset{O}{\|}}{C}CH_2CH_2$—

$C_{16}H_{33}SO_2NHCH_2CH_2$—, $C_{12}H_{25}$ 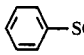 —$SO_2NHCH_2CH_2$—, $C_8H_{17}CONHCH_2CH_2$—, $C_{13}H_{27}CONHCH_2CH_2$—, $C_{15}H_{31}CONHCH_2CH_2$, $C_{17}H_{35}CONHCH_2CH_2$—,

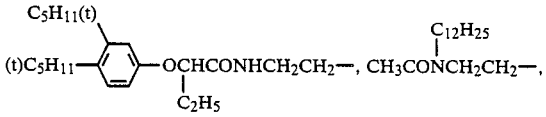

$C_{12}H_{25}NHCH_2CH_2$—, $C_{16}H_{33}NHCH_2CH_2$—,

-continued $C_{12}H_{25}NHCOCH_2$—, $C_{18}H_{37}NHCOCH_2$—, $C_{14}H_{29}O$ —NHCOCH$_2$CH$_2$—, $C_{16}H_{33}O$ NHCOCH$_2$—, $C_{12}H_{25}$ —, $C_{15}H_{31}$ —, $C_{18}H_{37}$ —, (t)$C_8H_{17}$ $OC_4H_9$ , $OC_8H_{17}$(n) (t)$C_4H_9$ $OC_8H_{17}$(n) , Cl $OC_{12}H_{25}$ , $NHCOC_{17}H_{35}$ , $NHSO_2$—$C_{12}H_{25}$ -continued $NHCOC_4H_9$ , —C—

In general formula [XXII], Y represents —O—, —S—, —SO—, and —$SO_2$—; and t is 0 or 1.

In general formula [P], X represents preferably a hydrogen atom and a halogen atom (F, Cl, Br, and I).

The coupler has the coupler residue which forms a dye through coupling with the oxidation product of the aromatic primary amine developing agent. The coupler residue is composed of the monomer coupler represented by general formula [I]. Typical examples of the monomer coupler are shown below through not limitative.

The monomer couplers may be used individually or in combination with one another.

(1)

$CH_2$=CH CONH OH Cl $CH_3$ Cl (2)

$CH_2$=C($CH_3$) $CONHC_2H_4CONH$ OH Cl $C_2H_5$ Cl (3)

$CH_2$=CH CONH OH N O Cl (4)

$CH_2$=C($CH_3$) $CONHC_2H_4OC_2H_4CONH$ OH N O Cl

-continued
(5)
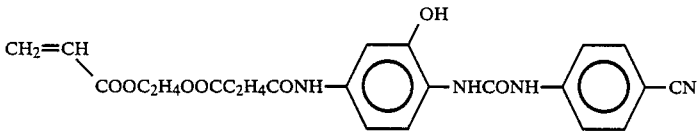
(6)
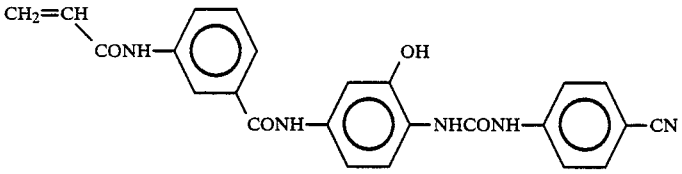
(7)
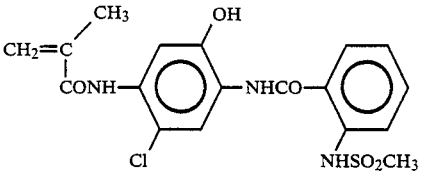
(8)
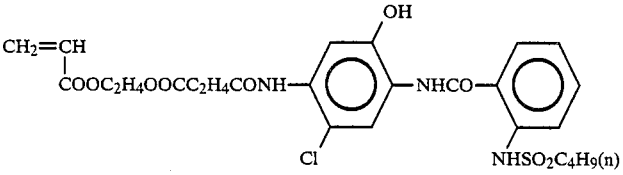
(9)
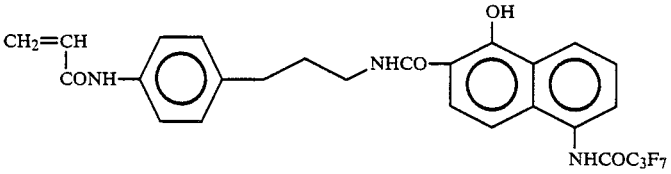
(10)
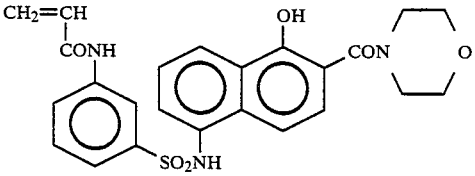
(11)
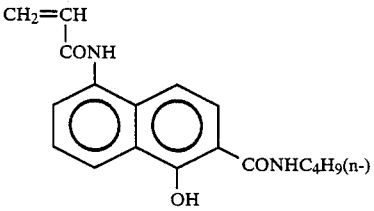
(12)
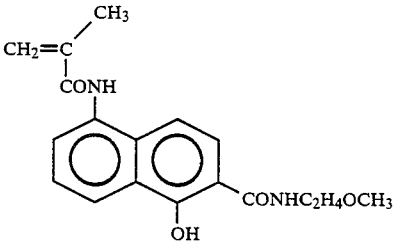

-continued
(13)
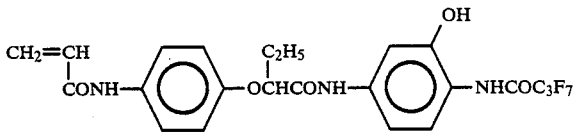
(14)
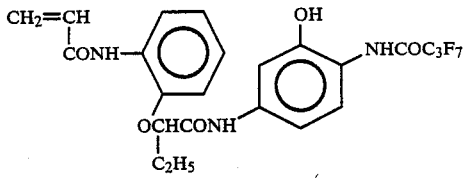
(15)
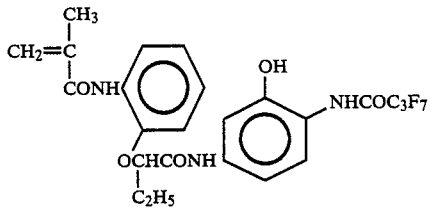
(16)
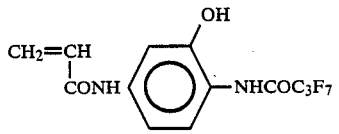
(17)
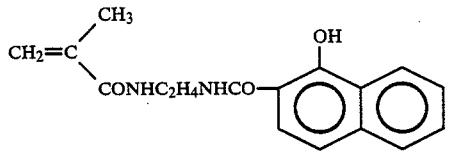
(18)
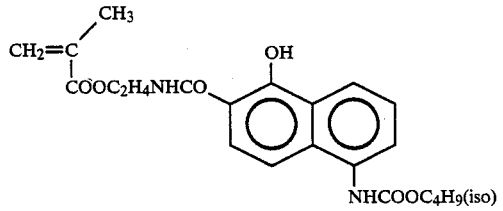
(19)
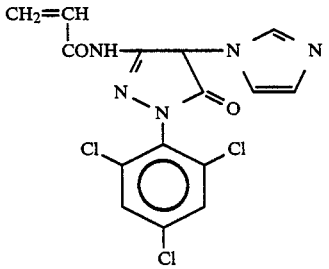
(20)
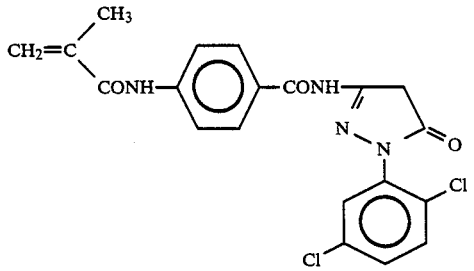

-continued
(21)
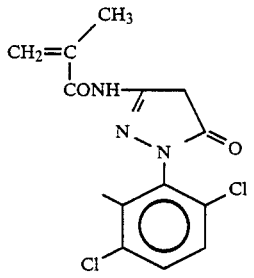
(22)
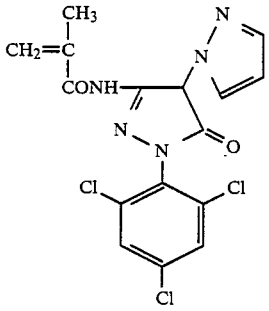
(23)
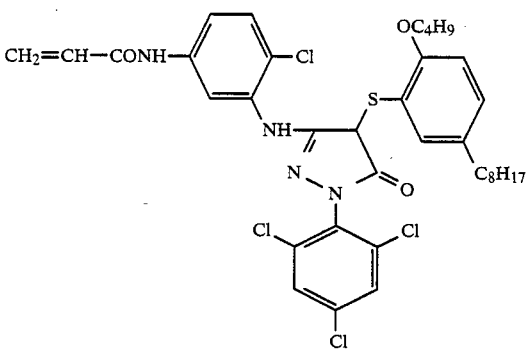
(24)
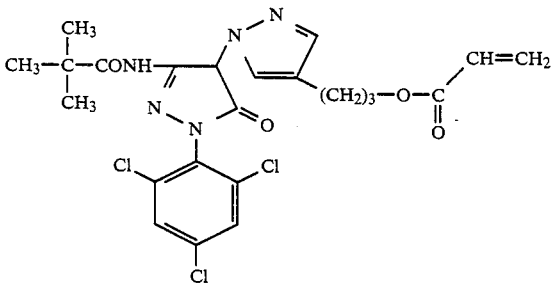
(25)
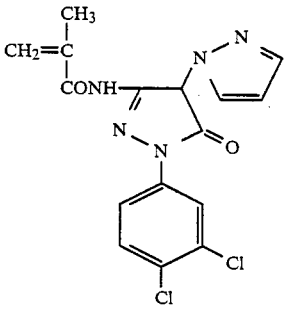

-continued
(26)
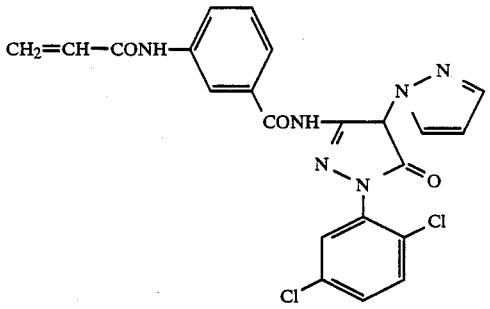
(27)
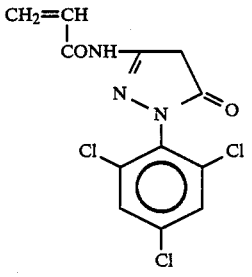
(28)
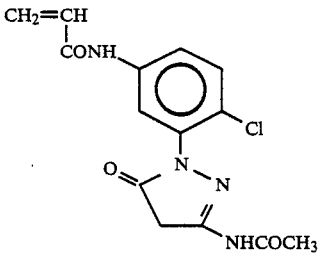
(29)
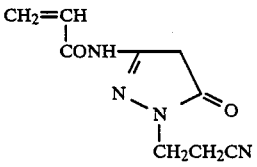
(30)
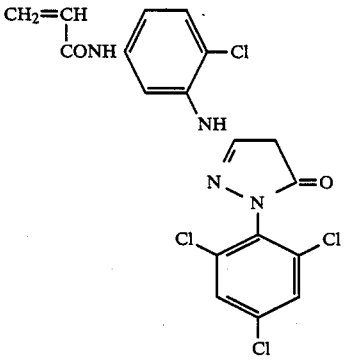
(31)
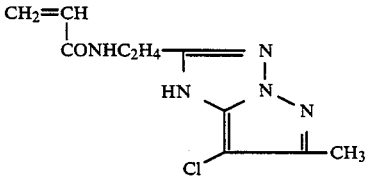

-continued
(32)
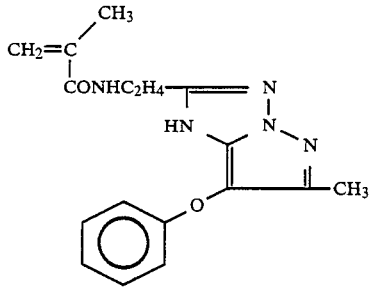
(33)
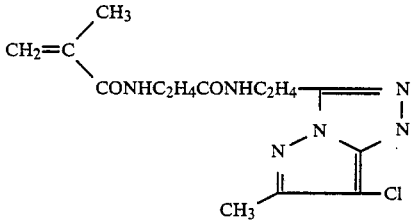
(34)
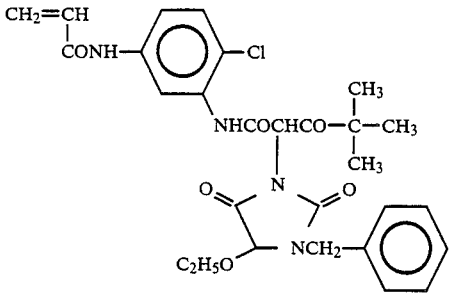
(35)
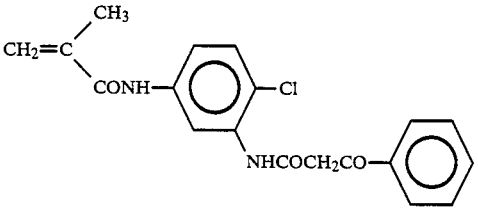
(36)
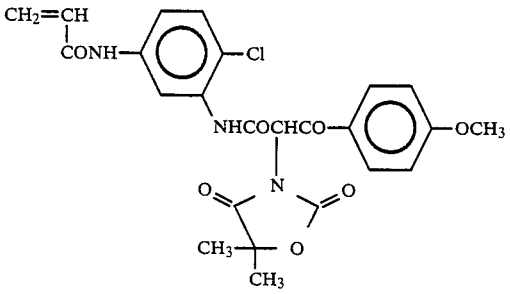
(37)
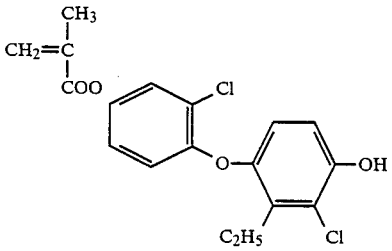

-continued
(38)
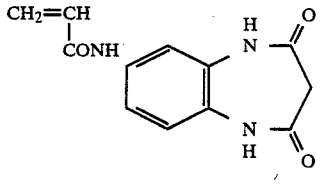
(39)
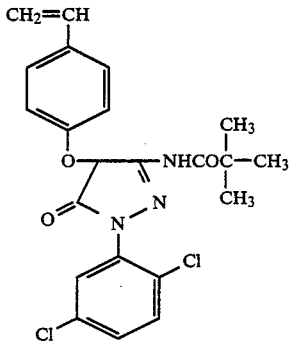
(40)
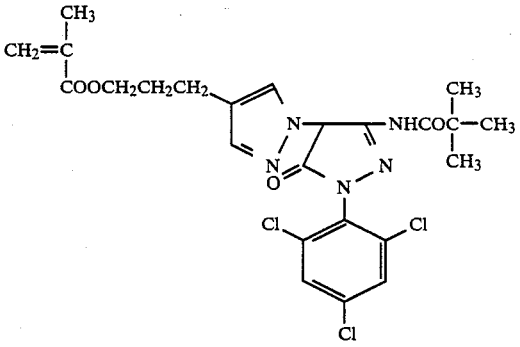
(41)
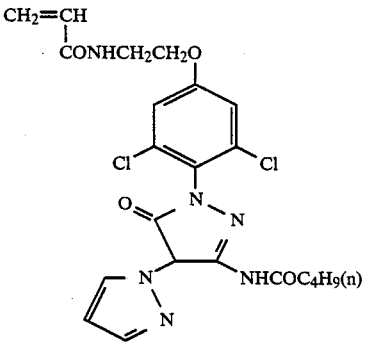
(42)
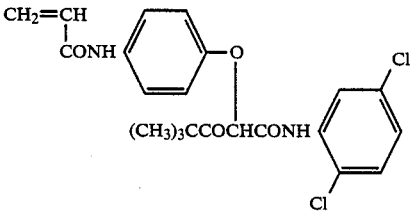
(43)
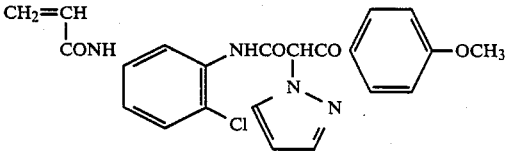

-continued (44)

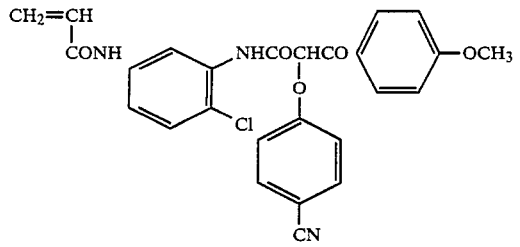

(45)

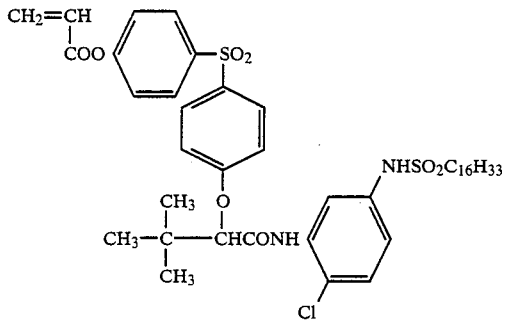

(46)

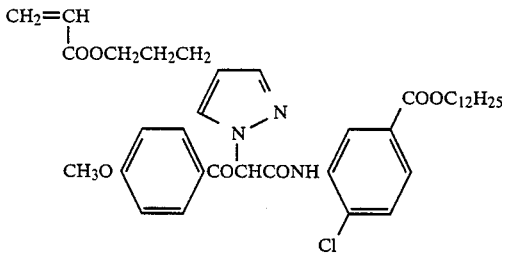

(47)

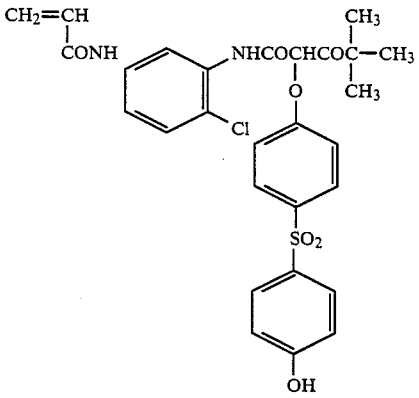

The chain transfer agents preferably employed in the present invention are enumerated below though not limitative.

$C_8H_{17}SH$, $C_{10}H_{21}SH$, $C_{12}H_{25}SH$, $C_{14}H_{29}SH$, $C_{15}H_{31}SH$, $C_{16}H_{33}SH$, $C_{18}H_{37}SH$, $C_{20}H_{41}SH$, $C_{31}H_{63}SH$, $C_8H_{17}OC(=O)CH_2SH$, $C_{12}H_{25}OC(=O)CH_2SH$, $C_{18}H_{37}OC(=O)CH_2SH$, $C_2H_5OC(=O)-CH(SH)C_{12}H_{25}$, $C_{12}H_{25}OC(=O)CH_2CH_2SH$, $C_{18}H_{37}OC(=O)CH_2CH_2SH$, $C_{16}H_{33}SO_2NHCH_2CH_2SH$,

-continued

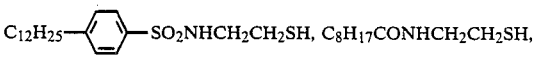

$C_{13}H_{27}CONHCH_2CH_2SH$, $C_{15}H_{31}CONHCH_2CH_2SH$, $C_{17}H_{25}CONHCH_2CH_2SH$,

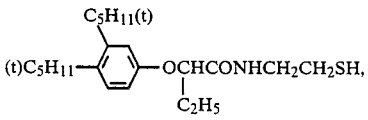

$CH_3CON(C_{12}H_{25})CH_2CH_2SH$, $C_{12}H_{25}NHCH_2CH_2SH$,

-continued $C_{16}H_{33}NHCH_2CH_2SH$, $C_{12}H_{25}NHCOCH_2SH$, $C_{18}H_{37}NHCOCH_2SH$, $C_{14}H_{22}O$—⟨benzene⟩—$NHCOCH_2CH_2SH$, $C_{16}H_{33}O$—⟨benzene⟩—$NHCOCH_2SH$, $C_{12}H_{25}$—⟨benzene⟩—SH, $C_{15}H_{31}$—⟨benzene⟩—SH, $C_{18}H_{37}$—⟨benzene⟩—SH,

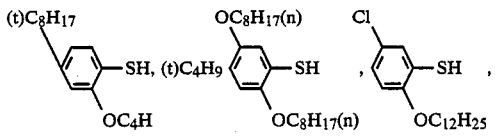

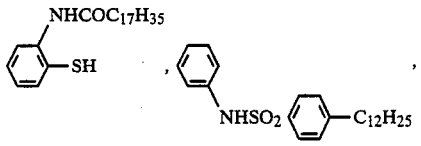

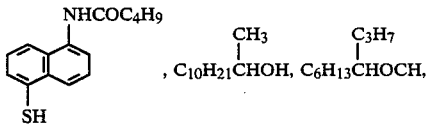

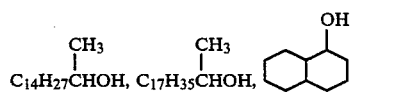

$BrCH_2COOC_{12}H_{25}$, $ClCH_2COOC_{12}H_{25}$, $ICH_2COOC_{12}H_{25}$, $BrCH_2COOC_{16}H_{33}$, $ClCH_2COOC_{18}H_{37}$, $ICH_2COOC_{18}H_{37}$, $Br_2CHCOOC_{12}H_{25}$, $Cl_3CCOOC_{16}H_{33}$,

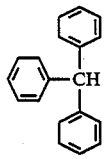

The polymer coupler obtained by the polymerization which employs the chain transfer agent specified in the present invention may contain about 0.1 to about 20 wt % of the compound represented by general formula [XXIII] or [XXIV] given below in addition to the compound represented by general formula [P].

$$E\text{-}(A)_x\text{-}(B)_y\text{-}E \qquad [XXIII]$$

wherein E, A, B, x, and y are as defined above.

$$I\text{-}(A)_x\text{-}(B)_y\text{-}X \qquad [XXIV]$$

wherein A, B, x, y, and X are as defined above; and I represents a group derived from the radical formed by the decomposition of the polymerization initiator.

In addition to those compounds represented by the above-mentioned general formulas [XXIII] and [XXIV], there may exist other compounds formed according to the ability of chain transfer of the monomer solvent as the result of chain transfer in the monomer and polymerization solvent. This is described in T. Ohtsu "Radical Polymerization (I)", pp. 123–127, (Kagaku Dojin, 1971).

Such polymer of general formula [I] which is synthesized by using the chain transfer agent the present invention is called telomer.

A detailed description to telomer is found in M. Ohkawara "Oligomer", pp. 10–30, (Kodansha Scientific, 1976).

The synthesis of the telomer coupler in the present invention is characterized by its employment of a chain transfer agent having 8 or more carbon atoms, unlike the ordinary radical polymerization. In this case, the polymerization may be initiated and continued through the radical which has moved to the chain transfer agent, and the polymer is formed by the chain transfer to the chain transfer agent.

The chain transfer agent which may be used for the synthesis is one which is represented by E-X (E and X are as defined above). It is a carboxylic acid or an ester thereof, alcohol, thiol, ether, aldehyde, ketone, halogenated hydrocarbon, aliphatic acid chloride, or halogenated carboxylic acid as described in the above-mentioned "Oligomer". Most preferable among them are alcohol and thiol.

These chain transfer agents vary greatly in the activity of chain transfer reaction as described in, for example, J. Brandrup "Polymer Handbook" II-57–102, (John Wiley and Sons) and T. Ohtsu "Radical Polymerization", p. 128, (Kagaku Dojin, 1971). Thus the quantity of the chain transfer agent also varies according to the kind and the polymerization conditions (concentration, temperature, quantity of initiator, etc.) In some cases it is used in large quantity as the solvent, and in another case it is used in an amount of only about 1 mol % for the monomer.

The telomer coupler in the present invention is synthesized by using as the polymerization initiator and polymerization solvent the compounds described in Japanese patent application (OPI) Nos. 5543/1981, 94752/1982, 176038/1982, 204038/1982, 28745/1983, 10738/1983, 42044/1983, 145944/1983, and 42543/1984.

The amount of the polymerization initiator may be about 0.01 to 10 mol %, preferably 0.01 to 2.0 mol % for the monomer.

The polymerization temperature should be set according to the desired molecular weight of the telomer and the kind of initiator used. It may range from 0° C. or below to 100° C. or above, but usually is 30° C. to 100° C. The synthesis of telomer is performed at high temperatures, preferably in the range of from about 70° C. to 100° C.

The color-forming moiety A in the telomer coupler represented by general formula [I] may be 10–95 wt %, and preferably 20–90 wt % from the standpoint of color reproduction, color-forming property, and stability. This amount corresponds to an equivalent molecular weight of about 200–4000 (number of grams of the polymer containing 1 mol of the monomeric coupler) though not limitative.

The number-average molecular weight of the telomer in the present invention may preferably be about 1000 to 10,000, more preferably about 1000 to 5000, from the standpoint of color-forming property and sensitivity.

The telomer coupler of the present invention is added to a silver halide emulsion layer or an adjacent layer thereof.

The telomer coupler of the present invention may be added based on the coupler monomer in an amount 0.005 to 0.5 mol, preferably 0.01 to 0.10 mol per mol of silver.

When the telomer coupler of the present invention is added to a non-photosensitive layer, the amount is usually 0.01 to 1.0 g/m$^2$, preferably 0.1 to 0.5 g/m$^2$.

The number-average molecular weight of the telomer coupler can be obtained by gel permeation chromatography (GPC).

GPC is performed under the following conditions.

| | | |
|---|---|---|
| Column: | TSK gel (made by Toyo Soda Co., Ltd. Japan) $G1000H_8$<br>Exclusion limit molecular weight: 1,000<br>Dimensions: 7.51 D × 600 mm | One |
| | TSK gel (made by Toyo Soda Co., Ltd. Japan) $G2000H_8$<br>Exclusion limit molecular weight: 10,000<br>Dimensions: 7.51 D × 600 mm | Two |
| | TSK gel (made by Toyo Soda Co., Ltd. Japan) $G4000H_8$<br>Exclusion limit molecular weight: 400,000<br>Dimensions: 7.51 D × 600 mm | One |

Solvent: THF
Flow rate: 1 ml/min
Column temperature: 40° C.
Detector: UV-8, Model II (made by Toyo Soda Co., Ltd. Japan) TSK standard polystyrene (made by Toyo Soda Co., Ltd. Japan) for calibration The number-average molecular weight was calculated according to the general method, namely segments method, as described in "Experimental Methods for Polymer Science" compiled by the Society of Polymer Science, pp. 204–208 (Tokyo Kagaku Dojin, 1981). Calculations were performed according to the following relationship.

$$\text{Mn (number-average molecular weight)} = \frac{\Sigma_i M_i N_i}{\Sigma_i N_i} = \frac{\Sigma_i H_i D}{\Sigma_i (H_i D/M_i)} = \frac{\Sigma_i H_i}{\Sigma_i (H_i/M_i)} \quad (1)$$

$$\text{Consequently, Mn} = \frac{1}{\Sigma_i (1/M_i)(H_i/\Sigma_j H_j)}$$

where $H_1$ is the peak height from the base line measured for the ith polymer species when the chromatogram is divided into counts (D) at equal intervals. $N_i$ denotes the number of the ith polymer species and $M_i$ denotes the molecular weight of the ith polymer species. ($M_i$ can be obtained from the calibration curve.)

It will be easy, in accordance with the methods well-known in the field of polymer color coupler, to set the optimum physical or chemical properies of the copolymer represented by general formula [I] to attain desired solubility, compatibility with a binder such as gelatin in the photographic colloid composition, flexibility and heat stability.

The telomer coupler obtained by the polymerization of the monomer coupler is dissolved in an organic solvent, and the resulting solution is emulsified and dispersed into the aqueous solution of gelatin. Alternatively, it may also be produced directly be emulsion polymerization.

The emulsification and dispersion of the coupler into the aqueous solution of gelatin may be accomplished according to the method described in U.S. Pat. No. 3,451,820 and the emulsion polymerization may be accomplished according to the method described in U.S. Pat. Nos. 4,080,211 and 3,370,952.

Typical examples of the synthesis of the telomer coupler of the invention are shown in the following.

Synthesis Example 1

[Telomer coupler (I) (copolymer of monomer coupler (1) and butyl acrylate)]

In a 200-ml three-necked flask is placed 12 g of 5-acrylamido-2,4-dichloro-3-methylphenol [monomer coupler (1)], 10 g of butyl acrylate, 1.5 g of n-dodecylmercaptan, and 100 ml of ethanol, and the resulting mixture is then heated to 75° C. and stirred under a nitrogen stream. Then, to begin polymerization, 5 ml of an ethanol solution containing 0.21 g of dimethyl azobisisobutyrate is added. After the reaction has been continued for 5 hours, the solution is cooled and then poured into 1.5 liters of water. A deposited solid is collected by filtration and is then washed sufficiently with water. Then, this solid is dried by heating under reduced pressure to obtain 19.5 g of the telomer coupler (I).

By chlorine analysis, it is found that the thus obtained telomer coupler (I) contained 50.6% by weight the coupler unit of the monomer coupler (1). Its number-average molecular weight by GPC was 3,500.

Synthesis Examples 2 to 38

Following the same procedure as in Synthesis Example 1, telomer couplers (II) to (XXXVIII), shown in Table 1, are synthesized (chain transfer agents are changed on occasion to adjust molecular weights).

TABLE 1

| Synthesis Example | Telomer Coupler | Monomer Coupler (kind) | Monomer Coupler (amount) | Noncolor-Forming*1 Monomer (kind) | Noncolor-Forming*1 Monomer (amount) | Chain Transfer Agent | Monomer Coupler Unit in Polymer (wt %) | Number Average Molecular Weight |
|---|---|---|---|---|---|---|---|---|
| 1 | I | (1) | 12 g | BA | 10 g | $C_{12}H_{25}SH$ | 50.6 | 3500 |
| 2 | II | (1) | 15 g | BA | 4 g | $C_{10}H_{17}SH$ | 74.0 | 2200 |
| 3 | III | (2) | 12 g | BA | 10.5 g | $C_{12}H_{25}SH$ | 50.5 | 3700 |
| 4 | IV | (2) | 15 g | BA | 2 g | $C_{18}H_{37}SH$ | 73.2 | 3900 |
| | | | | MA | 2 g | | | |
| 5 | V | (3) | 12 g | MEA | 10.5 g | $C_{12}H_{25}SH$ | 49.5 | 3300 |
| 6 | VI | (4) | 15 g | MEA | 3 g | *2 | 73.1 | 3200 |
| 7 | VII | (14) | 12 g | BA | 9 g | $C_{12}H_{25}SH$ | 49.5 | 3100 |
| 8 | VIII | (14) | 12 g | BA | 9 g | $C_{12}H_{25}SH$ | 51.0 | 4500 |
| 9 | IX | (14) | 12 g | BA | 10 g | $C_{12}H_{25}SH$ | 51.8 | 7000 |

TABLE 1-continued

| Synthesis Example | Telomer Coupler | Monomer Coupler (kind) | Monomer Coupler (amount) | Noncolor-Forming*1 Monomer (kind) | Noncolor-Forming*1 Monomer (amount) | Chain Transfer Agent | Monomer Coupler Unit in Polymer (wt %) | Number Average Molecular Weight |
|---|---|---|---|---|---|---|---|---|
| 10 | X | (14) | 12 g | MA | 9 g | $C_{18}H_{37}O\overset{O}{\overset{\|\|}{C}}CH_2CH_2SH$ | 50.3 | 4000 |
| 11 | XI | (14) | 15 g | BA | 2 g | $C_{12}H_{25}SH$ | 74.9 | 1700 |
| 12 | XII | (14) | 15 g | BA | 3 g | $C_{12}H_{25}SH$ | 75.2 | 5500 |
| 13 | XIII | (14) | 15 g | MEA | 2 g | $C_{12}H_{25}\overset{CH_3}{\overset{\|}{C}}HOH$ | 73.7 | 6800 |
| 14 | XIV | (14) | 15 g | MEA | 3 g | $C_8H_{17}SH$ | 75.9 | 2300 |
| 15 | XV | (14) | 15 g | — | | $C_{12}H_{25}SH$ | 84.9 | 1500 |
| 16 | XVI | (14) | 15 g | MEA | 1 g | $C_{12}H_{25}SH$ | 85.1 | 2300 |
| 17 | XVII | (14) | 15 g | — | | $C_{12}H_{25}SH$ | 90.2 | 2100 |
| 18 | XVIII | (16) | 12 g | EA | 10 g | $C_{14}H_{29}SH$ | 51.8 | 3600 |
| 19 | XIX | (17) | 12 g | St | 5 g | $C_{17}H_{35}CONHCH_2CH_2SH$ | 49.7 | 4100 |
| | | | | MA | 5 g | | | |
| 20 | XX | (18) | 12 g | BA | 10 g | $C_{12}H_{25}SH$ | 50.9 | 3900 |
| 21 | XXI | (19) | 12 g | BA | 10 g | $C_{12}H_{25}SH$ | 52.0 | 4800 |
| 22 | XXII | (21) | 12 g | BA | 10 g | $C_{12}H_{25}SH$ | 50.7 | 3700 |
| 23 | XXIII | (21) | 15 g | BA | 1.5 g | *3 | 72.8 | 1600 |
| | | | | MA | 1.5 g | | | |
| 24 | XXIV | (22) | 12 g | BA | 10 g | $C_{12}H_{25}SH$ | 51.0 | 2900 |
| 25 | XXV | (22) | 12 g | BA | 10 g | $C_{12}H_{25}SH$ | 52.5 | 6400 |
| 26 | XXVI | (22) | 15 g | BA | 3 g | $C_{12}H_{25}SH$ | 75.3 | 2400 |
| 27 | XXVII | (22) | 15 g | BA | 2.5 g | $C_{12}H_{25}SH$ | 75.1 | 1800 |
| 28 | XXVIII | (22) | 15 g | BA | 1 g | $C_{12}H_{25}SH$ | 85.1 | 2800 |
| 29 | XXIX | (22) | 15 g | MA | 1 g | $C_{18}H_{37}SH$ | 84.8 | 3800 |
| 30 | XXX | (22) | 15 g | — | | $C_{12}H_{25}SH$ | 89.5 | 2200 |
| 31 | XXXI | (23) | 15 g | BA | 3 g | $C_{12}H_{25}SH$ | 74.8 | 2100 |
| 32 | XXXII | (23) | 15 g | — | | $C_{12}H_{25}SH$ | 90.8 | 2400 |
| 33 | XXXIII | (23) | 12 g | BA | 9 g | $C_{12}H_{25}SH$ | 50.6 | 1600 |
| 34 | XXXIV | (27) | 15 g | MMA | 2 g | 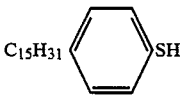 | 76.3 | 2200 |
| 35 | XXXV | (31) | 12 g | BA | 10 g | $C_{12}H_{25}SH$ | 49.7 | 2700 |
| 36 | XXXVI | (32) | 12 g | MEA | 10 g | $C_{12}H_{25}SH$ | 50.1 | 3400 |
| 37 | XXXVII | (35) | 15 g | AA | 2 g | $C_{12}H_{25}SH$ | 67.2 | 3700 |
| | | | | BA | 4 g | | | |
| 38 | XXXVIII | (36) | 12 g | MEA | 9 g | $C_{12}H_{25}NHCOCH_2SH$ | 50.9 | 3200 |

*1MA: Methyl acrylate
EA: Ethyl acrylate
AA: Acrylic acid
EMA: 2-Methoxyethyl acrylate
MMA: Methyl methacrylate
St: Styrene
BA: Butyl acrylate

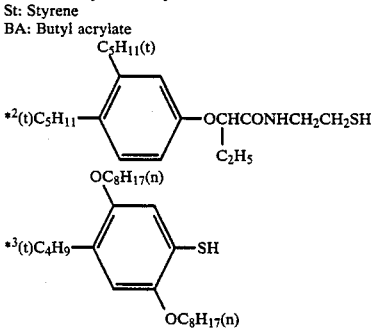

Comparative Synthesis Example 1

[copolymer of monomer coupler (14) and butyl acrylate]

A mixture of 20 g of the monomer coupler (14), 20 g of butyl acrylate, and 200 of ethyl acetate is heated to 70° C. while being stirred under a nitrogen stream. To begin polymerization, 10 ml of an ethyl acetate solution containing 0.5 g of dimethyl azobisisobutyrate is added. After the reaction has been continued for 5 hours, the solution is cooled and then poured into 1.5 liters of water. A deposited solid is collected by filtration and is then washed sufficiently with water.

Then, this solid is dried by heating under reduced pressure to obtain 37.3 g of a polymer coupler (A) for comparison.

By fluorine analysis, it is found that the thus obtained polymer coupler contained 50.2% by weight the coupler unit of the monomer coupler (14). Its number-average molecular weight by GPC is 41,000.

Comparative Synthesis Example 2

[copolymer of the monomer coupler (14) and butyl acrylate]

Following the same procedure as in Comparative Synthesis Example 1, except that 30 g of the monomer coupler (14) and 10 g of butyl acrylate are used, a polymer coupler (B) is synthesized for comparison. According to fluorine analysis, the content of the coupler unit of the monomer coupler (14) is 74.6% by weight, and its number average molecular weight by GPC is 18,000.

Comparative Synthesis Example 3

[copolymer of monomer coupler (14) and butyl acrylate]

Under the same conditions as in Comparative Synthesis Example 1, except that the polymerization solvent is used in a 10-fold amount and the initiator was used in a 4-fold amount, a polymer coupler (C) is obtained for comparison.

Polymer coupler (C) for comparison:
Number-average molecular weight 3,700
Coupler unit in polymer 48.7% by weight Comparative Synthesis Example 4

[copolymer of monomer coupler (14) and butyl acrylate]

Under the same conditions as in Comparative Synthesis Example 2, except that the polymerization solvent is used in a 8-fold amount and the initiator was used in a 2-fold amount, a polymer coupler (D) is obtained for comparison.

Polymer coupler (D) for comparison:
Number-average molecular weight 3,200
Coupler unit in polymer 73.9% by weight Comparative Synthesis Example 5

[copolymer of 1-(2,4,6-trichlorophenyl)-3-methacrylamido-4-pyrazolyl-2-pyrazoline-5-one (monomer coupler (22) and butyl acrylate]

A mixture of 20 g of the monomer coupler (22), 20 g of butyl acrylate, and 150 g of dimethylacetamide is heated to 75° C. while being stirred under a nitrogen stream. To begin polymerization, 10 ml of a dimethylacetamide solution containing 1.0 g of dimethyl azobisisobutyrate is added. After the reaction has been continuing for 5 hours, the solution is cooled and then poured into 3 liters of water. A deposited solid is collected by filtration and is then washed sufficiently with water. Then, this solid is dried by heating under reduced pressure to obtain 38.5 g of a polymer coupler (E) for comparison.

By chlorine analysis, it is found that the thus obtained polymer coupler contained 50.8% by weight the coupler unit of the monomer coupler (22). Its number-average molecular weight by GPC is 21,000.

Comparative Synthesis Example 6

[copolymer of monomer coupler (22) and butyl acrylate]

Following the same procedure as in Comparative Synthesis Example 3, except that 30 g of the monomer coupler (22) and 10 g of butyl acrylate are used, a polymer coupler (F) is synthesized for comparison. According to fluorine analysis, the content of the coupler unit is 75.3% by weight, and its number-average molecular weight by GPC is 13,000.

Comparative Synthesis Example 7

[copolymer of monomer coupler (22) and butyl acrylate]

Under the same conditions as in Comparative Synthesis Example 5, except that the polymerization solvent is used in a 4-fold amount and the initiator was used in a 10-fold amount, a polymer coupler (G) is obtained for comparison.

Polymer coupler (G) for comparison:
Number-average molecular weight 3,600
Coupler unit in polymer 48.5% by weight Comparative Synthesis Example 8

[copolymer of monomer coupler (22) and butyl acrylate]

Under the same conditions as in Comparative Synthesis Example 6, except that the polymerization solvent is used in a 4-fold amount and the initiator was used in a 3-fold amount, a polymer coupler (H) is obtained for comparison.

Polymer coupler (H) for comparison:
Number-average molecular weight 3,800
Coupler unit in polymer 73.6% by weight Comparative Synthesis Example 9 to 12

[copolymer of monomer coupler (1) and butyl acrylate]

Under the same conditions as in each of Comparative Synthesis Example 1 to 4, polymer couplers (I) to (L) were synthesized for comparison.

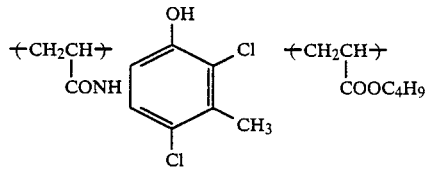

| Comparative Synthesis Example | Compound | Content of Coupler Unit (wt %) | Number Average Molecular Weight |
|---|---|---|---|
| 9 | (I) | 51.9 | 44000 |
| 10 | (J) | 50.8 | 3700 |
| 11 | (K) | 74.9 | 15600 |
| 12 | (L) | 75.7 | 3500 |

Comparative Synthesis Example 13 to 16

[in 13 and 14, copolymers of monomer coupler (31) and butyl acrylate; and in 15 and 16, copolymers of monomer coupler (23) and butyl acrylate]

Polymer couplers (M) and (O) are sunthesized for comparison under the same conditions as in Comparative Synthesis Example 5, as were also polymer couplers (N) and (P) under the same conditions as in Comparative Synthesis Example 6.

| Comparative Synthesis Example | Compound | Monomer Coupler | Noncolor-Forming Monomer | Content of Coupler Unit (wt %) | Number Average Molecular Weight |
|---|---|---|---|---|---|
| 13 | (M) | (31) | BA | 50.0 | 36000 |
| 14 | (N) | (31) | BA | 50.8 | 3500 |
| 15 | (O) | (23) | BA | 46.4 | 23000 |
| 16 | (P) | (23) | BA | 50.8 | 2500 |

In an emulsion for the photographic material used in this invention, there can be employed any silver halide of silver bromide, silver iodobromide, silver chlorobromoiodide, silver chlorobromide and silver chloride.

The preferable silver halides are silver iodobromide and silver chlorobromoiodide, containing about 30 mol % or less of silver iodide. The most preferable is silver iodobromide containing about 2 to 25 mol % of silver iodide.

The silver halide grains in the photographic emulsion may be so-called regular grains having a regular crystal structure, such as cubic, octahedron and tetradecahedron, grains having an irregular crystal structure, such as spherical, grains having crystalline defects, such as twin surfaces, or composite grains thereof.

The diameters of the silver halide grains usable in this invention range from about 0.1 microns or less to about 10 microns in projected area diameter, and in the present invention both a monodisperse emulsion having a narrow distribution, and a polydisperse emulsion having an extensive distribution can be used.

The silver halide photographic emulsion which is usable in the present invention can be prepared by known methods disclosed in, for example, Research Disclosure (RD), No. 17,643, "I. Emulsion Preparation and Types", Dec. 1978, p. 22–23, RD, No. 18,716, Nov. 1979, p. 648; Glafkides, "Chimie et Physique Photographique", Paul Montel, 1967, G. F. Duffin, "Photographic Emulsion Chemistry", Focal Press, 1966, and V. L. Zelikman et al, "Making and Coating Photographic Emulsion", Focal Press, 1964. In short, for the purpose of preparing the photographic emulsion used in the present invention, any acid method, neutral method, ammonia method or the like is acceptable. Further, as a method for reacting a soluble silver salt with a solubale halogen salt, there can be employed any single-jet method, double-jet method, or combination thereof. In addition, it is possible to use a so-called reverse mixing method for forming the grains in the presence of an excessive silver ion. As one example of the double-jet method, there can be used a method for constantly maintaining the pAg of the liquid phase in which the silver halide is formed, i.e., a controlled double-jet method. The latter method can provide a silver halide emulsion having regular and nearly uniform crystal grains.

It may also be acceptable that two or more types of separately formed silver halide emulsions are mixed together.

The silver halide emulsion comprising the above mentioned regular grains can be prepared by controlling the pAg and pH of the liquid phase in which the grains are being formed. This technique is described in detail in, for example, Photographic Science and Engineering, Vol. 6, 1962, p. 159–165, Journal of Photographic Science, Vol. 12, 1964, p. 242–251, U.S. Pat. No. 3,655,394 and British Pat. No. 1,413,748.

The typical monodisperse emulsion contains grains with an average diameter larger than about 0.1 micron and in which at least about 95% by weight are within ±40% of the average grain diameter. The present invention can make use of an emulsion containing silver halide grains the average diameter of which is within about 0.25 to 2 microns, and in which at least about 95% by weight are within ±20% of the average grain diameter. Methods for preparing such emulsions are disclosed in U.S. Pat. Nos. 3,574,628 and 3,655,394 and British Pat. No. 1,413,748.

In addition, the present invention can utilize such monodisperse emulsions as are disclosed in Japanese patent application (OPI) Nos. 8,600/1973, 39,027/1976, 83,097/1976, 137,133/1978, 48,521/1979, 99,419/1979, 37,635/1983 and 49,938/1983.

Moreover, tabular grains having an aspect ratio of about 5 or more can also be used in the present invention. Such tabular grains can be simply manufactured in accordance with methods disclosed in Gutoff, "Photographic Science and Engineering", Vol. 14, 1970, p. 248–257, U.S. Pat. Nos. 4,434,226, 4,414,310, 4,433,048 and 4,439,520, and British Pat. No. 2,112,157. The above mentioned U.S. Pat. No. 4,434,226 also documents that the employment of tabular grains improves color sensitization efficiency by a sensitizing dye, graininess, and sharpness.

The grains may be of uniform crystalline structure, a non-uniformed structure in which the inside portion of each grain is different from the outside portion as to halogen composition, or a layer-like crystalline structure. These emulsion grains are disclosed in British Pat. No. 1,027,146, U.S. Pat. Nos. 3,505,068 and 4,444,877 and Japanese patent application No. 248,469/1983. Further regarding the crystalline structure of the grains, silver halide crystals having different compositions may be connected with each other by an epitaxial connection, and each crystalline grain may be connected with a compound other than the silver halide such as silver rhodanide or lead oxide. These emulsion grains are disclosed in U.S. Pat. Nos. 4,094,684, 4,142,900 and 4,459,353, British Pat. No. 2,038,792, U.S. Pat. Nos. 4,349,622, 4,395,478, 4,433,501, 4,463,087, 3,656,962 and 3,852,067, and Japanese patent application (OPI) No. 162,540/1984. In addition, a mixture of various crystalline grains can be used as the emulsion grains.

In the present invention, an emulsion can usually be used which has been subjected to physical-ripening and chemical-ripening and spectral sensitization. Additives used at such steps are described in RD Nos. 17,643 and 18,716, and the relevant portions thereof are summarized in the table below.

The known additives for photography which can be used in the present invention are also described in the above mentioned two RD's and these additives are listed together with the portions corresponding thereto in the following table:

| Additive | RD17643 Page | RD18716 Page |
|---|---|---|
| 1. Chemical Sensitizer | 23 | 648 (Right column) |
| 2. Sensitivity Improver | | 648 (Right column) |
| 3. Spectral Sensitizer, Strong Color Sensitizer | 23–24 | 648 (Right column)–649 (Right column) |
| 4. Bleaching Agent | 24 | |
| 5. Antifoggant, Stabilizer | 24–25 | 649 (Right Column) |
| 6. Light Absorber, Filter Dye, Ultra Absorbent | 25–26 | 649 (Right column)–650 (Left column) |
| 7. Stain Inhibitor | 25 (Right column) | 650 (Left–Right column) |
| 8. Dye Image Stabilizer | 25 | |
| 9. Hardening Agent | 26 | 651 (Left column) |
| 10. Binder | 26 | 651 (Left column) |
| 11. Plasticizer, Lubricant | 27 | 650 (Right column) |
| 12. Coating Aid, Surface Active Agent | 26–27 | 650 (Right column) |
| 13. Static Inhibitor | 27 | 650 (Right column) |

In the present invention, a variety of color couplers can be used and examples of these couplers are described in the patents referred to in paragraphs VII-C to VII-G in the above mentioned RD No. 17,643. Regarding dye-forming couplers, those that can provide three primary colors (i.e., yellow, magenta and cyan) for a subtractive color process. The couplers preferably used in the present invention are nondiffusible four equivalent or two equivalent couplers which are disclosed in paragraphs VII-C and VII-D of the above mentioned RD 17,643, and couplers which will be mentioned hereafter.

Typical yellow couplers used in the present invention are hydrophobic acylacetamide series couplers, each having a ballast group. Examples of such couplers are disclosed in U.S. Pat. Nos. 2,407,210, 2,875,057, and 3,265,506. In the present invention, the two equivalent yellow couplers can be used preferably, and examples are oxygen atom coupling split-off type yellow couplers disclosed in U.S. Pat. Nos. 3,408,194, 3,447,928, 3,933,501, and 4,022,620, and nitrogen atom coupling split-off type yelow couplers disclosed in Japanese Patent Publication No. 10,739/1983, U.S. Pat. Nos. 4,401,752 and 4,326,752 and 4,326,024, RD 18,053 (Apr. 1979), British Pat. No. 1,425,020, West German patent application (OLS) Nos. 2,219,917, 2,261,361, 2,329,587, and 2,433,812. α-Pivaloylacetanilide series couplers form a dye having excellent fastness property, especially excellent fastness to light, and, on the other hand, α-benzoylacetanilide series couplers provide high color density.

Examples of the magenta couplers which can be used in the present invention include indazolone series and cyanoacetyl series couplers, and preferably 5-pyrazolone series and pyrazoloazole series couplers, all of which are hydrophobic and have a ballast group. Of the 5-pyrazolone series couplers, those in which each 3-position is substituted by an arylamino group or an acylamino group are preferable from the standpoint of the hue of the dye and color density. Such preferred examples are disclosed in U.S. Pat. Nos. 2,311,082, 2,343,703, 2,600,788, 2,908,573, 3,062,653, 3,152,896, and 3,936,015. Coupling split-off groups of the two equivalent 5-pyrazolone series couplers preferably are nitrogen atom coupling split-off groups disclosed in U.S. Pat. No. 4,310,619, and arylthio groups disclosed in U.S. Pat. No. 4,351,897. The 5-pyrazolone series couplers each having the ballast group disclosed in European Pat. No. 73,636 can provide high color density. Examples of the pyrazoloazole series couplers include pyrazolobenzimidazoles disclosed in U.S. Pat. No. 3,061,432, preferably pyrazolo[5,1-c][1,2,4]-triazoles disclosed in U.S. Pat. No. 3,725,067, pyrazolotetrazoles disclosed in RD No. 24,220 (June 1984) and Japanese patent application (OPI) No. 33,552/1985, and pyrazolopyrazoles disclosed in RD No. 24,230 (June 1984) and Japanese patent application (OPI) No. 43,659/1985. The imidazo[1,2-b]pyrazoles disclosed in U.S. Pat. No. 4,500,630 are preferable because of less secondary absorption of yellow color in the color dye, and because of their excellent fastness to light. Pyrazolo[1,5-b]-[1,2,4]triazoles, disclosed in U.S. Pat. No. 4,540,654, are especially preferable.

Examples of cyan couplers which can be used in the present invention include hydrophobic and nondiffusible naphthol series and phenol series couplers. Such naphthol series couplers are disclosed in U.S. Pat. No. 2,474,293, and examples of the preferable oxygen atom coupling split-off type two equivalent naphthol series couplers are disclosed in U.S. Pat. Nos. 4,052,212, 4,146,396, 4,228,233, and 4,296,200. Further, examples of phenol series couplers are disclosed in U.S. Pat. Nos. 2,369,929, 2,801,171, 2,772,162, and 2,895,826.

Couplers which can form moisture-resistant and temperature-resistant cyan dyes are preferable for use in the present invention. Examples of such preferred couplers include phenol series cyan couplers with an alkyl group selected from ethyl or larger alkyl at a meta-position on a phenol nucleus, as disclosed in U.S. Pat. No. 3,772,002, 2,5-diacylamino-substituted phenol series couplers disclosed in U.S. Pat. Nos. 2,772,162, 3,758,308, 4,126,396, 4,334,011, and 4,327,173, West German patent application (OLS) No. 3,329,729 and European Pat. No. 121,365, and phenol series couplers each having a phenylureido group at the 2-position and an acylamino group at the 5-position of the phenol nucleus, as disclosed in U.S. Pat. Nos. 3,446,622, 4,333,999, 4,451,559, and 4,427,767. Cyan couplers in which the 5-position of each naphthol nucleus is substituted by a sulfonamido group or an amido group can also be used preferably in the present invention, and these couplers are disclosed in European Pat. No. 161,626A. The couplers provide color images having excellent fastness properties.

In order to inhibit unnecessary absorption of color dye, it is preferred that a colored coupler be additionally used in a color photographic material for photographing so that masking can be provided. Typical examples of such colored couplers include yellow-colored magenta couplers disclosed in U.S. Pat. No. 4,163,670 and Japanese Patent Publication No. 39,413/1982, and magenta-colored cyan couplers disclosed in U.S. Pat. Nos. 4,004,929 and 4,138,258 and British Pat. No. 1,146,368. Other colored couplers which are usable in the present invention are mentioned in paragraph VII-G of the above mentioned RD 17,643.

In order to improve graininess, a coupler which forms a dye having moderate diffusibility is used additionally. Such couplers include magenta couplers disclosed in U.S. Pat. No. 4,366,237 and British Pat. No. 2,125,570, and yellow, magenta and cyan couplers disclosed in European Pat. No. 96,570 and West German patent application (OLS) No. 3,234,533.

The color-forming couplers and the above mentioned special couplers may be those which produce polymers of dimers or more. Examples of polymerized dye-forming couplers are disclosed in U.S. Pat. Nos. 3,451,820 and 4,080,211. Additionally, examples of polymerized magenta couplers are disclosed in British Pat. No. 2,102,173 and U.S. Pat. No. 4,367,282.

A coupler for releasing a photographically useful residue during coupling can also be used preferably in the present invention. Valuable examples of DIR couplers for releasing a development restrainer include couplers of patents referred to in paragraph VII-F of the above mentioned RD 17,643.

Examples of the couplers which can be preferably used in the present invention include developer-inactivating type couplers, disclosed in Japanese patent application (OPI) No. 151,944/1982, timing type couplers disclosed in U.S. Pat. No. 4,248,962 and Japanese patent application (OPI) No. 154,234/1982, and reactive type couplers disclosed in Japanese patent application No. 39,653/1984. Especially preferable examples include developer-inactivating type DIR couplers disclosed in Japanese patent application (OPI) Nos. 151,944/1982 and 217,932/1983, Japanese patent application Nos. 75,474/1984, 82,214/1984, and 90,348/1984, and reactive type DIR couplers disclosed in Japanese patent application No. 39,653/1984.

In the photographic material of the present invention, there may be used a coupler for releasing a nucleating agent, a development accelerator, or a precursor thereof imagewise at the time of developing. Examples of such coupler compounds are disclosed in British Pat. Nos. 2,097,140 and 2,131,188. Especially preferable are couplers for releasing the nucleating agent and the like, having an adsorbing function to the silver halide, and examples of such are disclosed in Japanese patent application (OPI) Nos. 157,638/1984 and 170,840/1984.

Bases which can be properly used in the present invention are disclosed, for example, on page 28 of the above mentioned RD No. 17,643, and on pages 647 and 648 of RD No. 18,716.

The color photographic material regarding the present invention can be developed in accordance with any of the usual methods described on pages 28 and 29 of the above RD No. 17,643 and on page 651 of RD No. 18,716.

For color development processing of the photographic material of the present invention, it is desirable to use an alkaline aqueous solution composed mainly of a color developing agent of aromatic primary amine type. As the color developing agent, an aminophenol compound may be used, but the use of a p-phenylenediamine compound is preferable. Examples of such a compound are 3-methyl-4-amino-N-ethyl-N-β-hydroxyethylaniline, 3-methyl-4-amino-N-ethyl-N-β-methanesulfonamido-ethylaniline, and 3-methyl-4-amino-N-ethyl-N-β-methyoxyethylaniline, sulfates thereof, hydrochlorides thereof, and p-toluenesulfonates thereof. The amines are used in the form of salts, because these salts are stable rather than the free amine forms.

The color developing solution generally contains a pH buffer such as alkali metal carbonate, borate, and phosphate; a development retarder such as bromide, iodide, benzimidazole, benzothiazole, and mercapto; and an antifoggant. In addition, the color developing solution may be incorporated, as required, with a preservative such as hydroxylamine and sulfite; an organic solvent such as triethanolamine and diethylene glycol; a development accelerator such as benzyl alcohol, polyethylene glycol, quaternary ammonium salt, and amine; dye forming couplers and competitive couplers; a nucleating agent such as sodium boron hydride; an auxiliary developing agent such as 1-phenyl-3-pyrazolidone; a thickening agent; a chelating agent such as amino polycarboxylic acid, amino polysulfonic acid, alkylsulfonic acid, and phosphonocarboxylic acid; and an antioxidant as disclosed in West German patent application (OLS) No. 2,622,950.

In the development processing of color reversal material, black and white development is usually performed prior to color development. For the black and white developing solution, it is possible to use any known black and white developing solution, it is possible to use any known black and white developing agent such as dihydroxybenzenes (e.g. hydroquinone), 3-pyrazolidones (e.g., 1-phenyl-3-pyrazolidone), and aminophenols (e.g., N-methyl-p-aminophenol), individually or in combination with one another.

After color development, the photographic emulsion layer usually undergoes bleaching treatment. The bleaching may be performed simultaneously with or separately from fixing treatment. Bleaching-fixing may be performed after bleaching so as to speed up the processing. The bleaching agent includes compounds of polyvalent metal such as iron (III), cobalt (III), chromium (VI), and copper (II), peracids, quinones, and nitron compounds. Examples of the bleaching agent are ferricyanides, dichromates, organic complex salts of iron (III) or cobalt (III) (e.g., complex salts of aminopolycarboxylic acid such as ethylenediamine-tetraacetic acid, diethylenetriaminepentaacetic acid, nitrilotriacetic acid, and 1,3-diamino-2-propanoltetraacetic acid; and complex salts of organic acid such as citric acid, tartaric acid, and malic acid), persulfates, manganates, and nitrosophenol. Iron (III) ethylenediaminetetraacetate and pursulfates are preferable among them in view of rapid treatment and environmental pollution. Especially, iron (III) ethylenediaminetetraacetate is useful for the independent bleaching solution as well as the combined developing and fixing bath.

The bleaching bath or the bleach-fix bath may be incorporated with a variety of accelerators as required. Examples of the bleach accelerators are the compounds having a mercapto group or disulfido group as disclosed in U.S. Pat. No. 3,893,858, West German Pat. Nos. 1,290,812 and 2,059,988, Japanese patent application (OPI) Nos. 32736/1978, 57831/1978, 37418/1978, 65732/1978, 72623/1978, 95630/1978, 95631/1978, 104232/1978, 124424/1978, 141623/1978 and 28426/1978 and RD No. 1 17129 (July, 1978), thiazoline compounds as disclosed in Japanese patent application (OPI) No. 140129/1975, thiourea compounds as disclosed in Japanese Patent Publication No. 8506/1970, Japanese patent application (OPI) Nos. 20832/1977 and 32735/1978 and U.S. Pat. No. 3,706,561, iodides as disclosed in West German Pat. No. 1,127,715 and Japanese patent application (OPI) No. 16235/1983, polyethylene oxides as disclosed in West German Pat. Nos. 966,410 and 2,748,430, polyamines as disclosed in Japanese Patent Publication No. 8836/1970, and iodine or bromine ions as disclosed in Japanese patent application (OPI) Nos. 42434/1974, 59644/1974, 94927/1978, 35727/1979, 26506/1980 and 163940/1983. Among the bleach accelerators, the compounds having a mercapto group or disulfido group are preferable in view of their accelerating effects, and those disclosed in U.S. Pat. No. 3,893,858 and West German Pat. No. 1,290,812 Japanese patent application (OPI) No. 95630/1978 are more preferable. Further, the compound disclosed in U.S. Pat. No. 4,522,834 is also preferable. The bleach accelerators may be added into the photographic material. These accelerations are effective especially when used for bleach-fix of the picture-taking color photographic material.

The fixing agent is a thiosulfate, thicyanate, thioether compound, thiourea, and iodide. A thiosulfate is preferable. The bleach-fix bath or the fixing bath is preferably incorporated with a preservative such as sulfite, bisulfite, and carbonyl-bisulfite adduct.

Bleach-fix or fixing is usually followed by washing. Water for washing may be incorporated with a variety of known compounds for the prevention of precipitation and the saving of water. For example, a water softner such as inorganic phosphoric acid, aminopolycarboxylic acid, and organic phosphonic acid may be added for the prevention of precipitation; and an antiseptic may be added for the inhibition of bacteria, algae, and molds. Other additives that may be added as required include metal salt such as magnesium salt and aluminum salt, a surface active agent that reduces drying load and that makes for uniform drying and a hardening agent. A compound as disclosed in Phot. Sci. Eng., Vol. 6 (1965), p. 344–359, Water Quality Criteria, by L. E. West may be used as an additive. The addition of a chelating agent and antiseptic agent is particularly effective.

The washing is usually performed in the counter current manner using two or more vessels in order to save water. The washing step may be replaced by the multistage countercurrent stabilizing step as disclosed in Japanese patent application (OPI) No. 8543/1982. This step requires 2 to 9 countercurrent baths incorporated with a variety of compounds for the stabilization of photographic images. Examples of the additives are buffers to adjust the pH of the gelatin emulsion to pH 3–9. (The buffers are prepared by combining boric acid, metaboric acid, borax, phosphate, carbonate, potassium hydroxide, aqueous ammonia, monocarboxylic acid, dicarboxylic acid, polycarboxylic acid, etc. with one another.) Other additives are chelating agents (e.g., inorganic phosphoric acid, aminopolycarboxylic acid, organic phosphoric acid, organic phosphonic acid, aminopolysulfonic acid, and phosphonocarboxylic acid), antiseptic agent (e.g., benzoisothiazolinone, isothiazolone, 4-thiazolinebenzimidazole, halogenated phenol sulfonyl amide and benzotriazole), surface active agent, fluorescent brightener, and hardening agent. Two or more additives for the same object may be used together.

In order to adjust the pH of the emulsion after processing, it is preferable to add an ammonium salt such as ammonium chloride, ammonium nitrate, ammonium sulfate, ammonium phosphate, ammonium sulfite, and ammonium thiosulfate.

In the picture-taking color photographic material usual washing-stabilizing step after fixing step can be replaced by the aforementioned stabilizing step and washing step (water saving treatment). In this case, when a two equivalent magenta coupler is used, the formalin in stabilizing bath may be omitted.

The washing and stabilizing time varies depending upon photographic materials and processing conditions and it usually takes 20 seconds to 20 minutes, and preferably 20 seconds to 5 minutes.

The silver halide color photographic material of this invention may be incorporated with precursors of color developing agents so as to simplify and speed up the processing. Examples of such precursors are indoaniline compounds (as disclosed in U.S. Pat. No. 3,342,597), Schiff base compounds (as disclosed in U.S. Pat. No. 3,342,599 and Research Disclosure Nos. 14850 and 15159), aldol compounds (as disclosed in Research Disclosure No. 13924), metal salt complexes (as disclosed in U.S. Pat. No. 3,719,492), urethane compounds (as disclosed in Japanese patent application (OPI) No. 135628/1978), and salt type precursors (as disclosed in Japanese patent application (OPI) Nos. 6235/1981, 83735/1981, 83736/1981, 89735/1981, 81837/1981, 54430/1981, 106241/1981, 107236/1981, 97531/1982, and 83565/1982).

The silver halide color photographic material of the present invention may be incorporated with a 1-phenyl-3-pyrazolidone as required so as to accelerate color development. Examples of such a compound are disclosed in Japanese patent application (OPI) Nos. 64339/1981, 144547/1982, 211147/1982, 50532/1983, 50536/1983, 50536/1983, 50533/1983, 50534/1983, 50535/1983, and 115438/1983.

The processing solutions for the photographic material of the present invention is used at 10° C. to 50° C., although the standard temperature is 33° C. to 38° C. The temperature may be raised to accelerate processing and to reduce the processing time. To the contrary, the temperature may be lowered to improve the photographic image quality and the stability of the processing solutions. For the saving of silver in the photographic material, the processing may be intensified by using cobalt or hydrogen peroxide as disclosed in West German Pat. No. 2,226,770 and U.S. Pat. No. 3,674,499.

The processing baths may be provided with a heater, temperature sensor, level sensor, circulating pump, filter, floating lid, squeezer, and the like, as required.

When continuous processing is practiced processing solutions can be replenished for the prevention of the composition fluctuation of the solutions to obtain finished photography having constant quality. The replenishing amount can be reduced to a half or less of the standard amount of replenishing.

The silver halide color photographic material of the present invention has high sensitivity, hard gradation and extremely high color density. The polymer coupler in the photographic material can show high color development properties, even when content of the coupler unit is high. Therefore, in the photographic material of the present invention, even a small amount of the coupler permits the couple unit to be contained at a higher concentration in the emulsion, and therefore it is possible to form a thinner layer and to improve the sharpness of the images. Further, in the present invention, the polymer coupler has sufficient non-migratory property, so that neither a mix of colors nor a drop in sensitivity occurs.

To further illustrate this invention, and not by way of limitation, the following examples are given.

EXAMPLE 1

A cellulose triacetate film base is coated with an emulsion layer and a protective layer as follows.

One hundred grams of coupler IV prepared in the above synthesis example is dissolved by heating at 60° C. in a mixture of 10 cc of tricresyl phosphate and 250 cc of ethyl acetate, and the resulting solution is mixed with 1,000 ml of an aqueous solution containing 100 g of gelatin and 10 g of sodium dodecylbenzenesulfonate at a temperature of 50° C. It is then agitated by a homogenizer at high speed to prepare a dispersion of the fine coupler grains.

To 1,000 g of this coupler dispersion is added 1,000 g of an iodobromide emulsion in which silver and iodine are each contained at an amount of 80 g and a concentration of 3 mol % respectively, and the above mentioned film base is then coated with the emulsion material such that the coating amount of the coupler might be $1.2\times10^{-4}$ mol/m$^2$.

This layer is further coated with a protective gelatin layer with a dry film thickness of 2 microns in order to prepare sample 101.

The same procedure is repeated using couplers V, VII, VIII, IX, XI, XII, XVII and XVIII so that a coating amount (mol/m$^2$) of each coupler and a mixing ratio of the coupler to silver might equal those of sample 101, thereby preparing samples 102 to 109. For comparison, samples 110 to 113 are prepared in a similar manner by the use of couplers (A), (B), (C), and (D) prepared in the above synthesis examples.

These samples are exposed to light through an optical wedge and then subjected to color development in accordance with processing steps given below:

Processing steps

| Step | Time | Temperature |
|---|---|---|
| First Development | 6 min. | 38° C. |
| Washing | 2 min. | " |
| Reversal | 2 min. | " |
| Color Development | 6 min. | " |
| Conditioning | 2 min. | " |
| Bleaching | 6 min. | " |
| Fixing | 4 min. | " |
| Washing | 4 min. | " |
| Stabilization | 1 min. | Ordinary Temperature |
| Drying | | |

The compositions of solutions used in the respective processing steps are as follows:

| First Developing Solution | |
|---|---|
| Water | 700 ml |
| Pentasodium nitrilo-N,N,N—trimethylenephosphonate | 2 g |
| Sodium sulfite | 20 g |
| Hydroquinone monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |

-continued

| | |
|---|---|
| Water | q.s. to 1,000 ml |

| Reversal Solution | |
|---|---|
| Water | 700 ml |
| Pentasodium nitrilo-N,N,N—trimethylenephosphonate | 3 g |
| Stannous chloride (dihydrate) | 1 g |
| p-Aminophenol | 0.1 g |
| Sodium hydroxide | 8 g |
| Glacial acetic acid | 15 ml |
| Water | q.s. to 1,000 ml |

| Color Developing Solution | |
|---|---|
| Water | 700 ml |
| Pentasodium nitrilo-N,N,N—trimethylenephosphonate | 3 g |
| Sodium sulfite | 7 g |
| Sodium tertiary phosphate (dodecahydrate) | 36 g |
| Potassium bromide | 1 g |
| Potassium iodide (0.1% solution) | 90 ml |
| Sodium hydroxide | 3 g |
| Citrazinic acid | 1.5 g |
| N—Ethyl-N—(β-methanesulfonamidoethyl)-3-methyl-4-aminoaniline sulfate | 11 g |
| 3,6-Dithiaoctane-1,8-diol | 1 g |
| Water | q.s. to 1,000 ml |

| Conditioner | |
|---|---|
| Water | 700 ml |
| Sodium sulfite | 12 g |
| Sodium ethylenediamine-tetraacetate (dihydrate) | 8 g |
| Thioglycerol | 0.4 ml |
| Glacial acetic acid | 3 ml |
| Water | q.s. to 1,000 ml |

| Bleaching Solution | |
|---|---|
| Water | 800 g |
| Sodium ethylenediamine-tetraacetate (dihydrate) | 2 g |
| Iron (III) ammonium ethylenediamine-tetraacetate (dihydrate) | 120 g |
| Potassium bromide | 100 g |
| Water | q.s. to 1,000 ml |

| Fixer | |
|---|---|
| Water | 800 g |
| Sodium thiosulfate | 80.0 g |
| Sodium sulfite | 5.0 g |
| Sodium bisulfite | 5.0 g |
| Water | q.s. to 1,000 ml |

| Stabilizer | |
|---|---|
| Water | 800 ml |
| Formalin (37% by weight) | 5.0 ml |
| Fuji Driwel (surface active agent made by Fuji Photo Film Co., Ltd.) | 5.0 ml |
| Water | q.s. to 1,000 ml |

The samples which has been processed are measured for densities of cyan due images and relative sensitivities.

The results thus obtained are set forth in Table 2.

TABLE 2

| Sample | Coupler (Coupler Monomer) | Comonomer | Coupler Content (%) | Number Average Molecular Weight | Cyan Color Image Dmax* | Cyan Color Image Relative** Sensitivity | Remarks |
|---|---|---|---|---|---|---|---|
| 101 | IV (2) | BA/MA | 73.2 | 3900 | 2.55 | 0.11 | This Invention |
| 102 | V (3) | MEA | 49.5 | 3300 | 3.80 | 0.08 | " |
| 103 | VII (14) | BA | 49.5 | 3100 | 4.00 | 0.06 | " |
| 104 | VIII (14) | BA | 51.0 | 4500 | 3.85 | 0.06 | " |
| 105 | IX (14) | BA | 51.8 | 7000 | 3.48 | 0.11 | " |
| 106 | XI (14) | BA | 74.9 | 1700 | 3.55 | 0.06 | " |
| 107 | XII (14) | BA | 75.2 | 5500 | 2.30 | 0.11 | " |
| 108 | XVII (14) | — | 90.2 | 2100 | 3.06 | 0.10 | " |
| 109 | XVIII (16) | BA | 51.8 | 3600 | 3.75 | 0.08 | " |

TABLE 2-continued

| Sample | Coupler (Coupler Monomer) | Comonomer | Coupler Content (%) | Number Average Molecular Weight | Cyan Color Image Dmax* | Cyan Color Image Relative** Sensitivity | Remarks |
|---|---|---|---|---|---|---|---|
| 110 | (A) | BA | 50.2 | 41000 | 2.32 | 0.00 | Comp. Example |
| 111 | (C) | BA | 48.7 | 3700 | 3.70 | −0.05 | " |
| 112 | (B) | BA | 74.6 | 18000 | 1.04 | −0.04 | " |
| 113 | (D) | BA | 73.9 | 3200 | 2.35 | −0.09 | " |

*Dmax: A maximum color density.
**Relative Sensitivity: A relative value of a cologarithm of an exposure enough to obtain D = 0.5, when the value of sample 110 is regarded as 0.00.

As is apparent from the results in Table 2, the samples containing the telomer couplers of the present invention are indicative of remarkably high color-forming property irrespective of the different contents of the coupler units, and these examples have much higher sensitivities compared with the samples containing the comparative couplers.

EXAMPLE 2

A multi-layer color photographic material 201 is prepared by coating a cellulose triacetate film base (with subbing layer) with layers of the following compositions.

The figure corresponding to each component stands for a cotaing amount in g/m$^2$, and the figure regarding each silver halide represents a coating amount in terms of silver. However, the figure regarding each sensitizing dye represents the coating amount per mol of the same silver halide.

| First Layer: Antihalation Coating | |
|---|---|
| Black colloidal silver | 0.15 |
| Ultraviolet absorbent U-1 | 0.08 |
| Ultraviolet absorbent U-2 | 0.12 |
| Gelatin | 1.3 |
| **Second Layer: Intermediate Layer** | |
| 2,5-di-t-pentadecylhydroquinone | 0.18 |
| Coupler C-3 | 0.05 |
| Gelatin | 1.5 |
| **Third Layer: First Red-Sensitive Emulsion Layer** | |
| Silver iodobromide (silver iodide 4 mol %; average grain size 0.5 micron) | 1.3 |
| Sensitizing dye I | $1.4 \times 10^{-4}$ |
| Sensitizing dye II | $0.4 \times 10^{-4}$ |
| Sensitizing dye III | $5.6 \times 10^{-4}$ |
| Sensitizing dye IV | $4.0 \times 10^{-4}$ |
| Coupler C-2 | 0.45 |
| Coupler C-3 | 0.035 |
| Coupler C-4 | 0.025 |
| High-boiling organic solvent HSB-1 | 0.50 |
| Gelatin | 2.0 |
| **Fourth Layer: Second Red-Sensitive Emulsion Layer** | |
| Silver iodobromide (silver iodide 8 mol %; average grain size 0.9 micron) | 1.1 |
| Sensitizing dye I | $5.2 \times 10^{-5}$ |
| Sensitizing dye II | $1.5 \times 10^{-5}$ |
| Sensitizing dye III | $2.1 \times 10^{-4}$ |
| Sensitizing dye IV | $1.5 \times 10^{-5}$ |
| Coupler C-2 | 0.050 |
| Coupler C-5 | 0.070 |
| Coupler C-3 | 0.035 |
| High-boiling organic solvent HSB-1 | 0.10 |
| Gelatin | 1.0 |
| **Fifth Layer: Intermediate Layer** | |
| 2,5-Di-t-pentadecylhydroquinone | 0.08 |

-continued

| | |
|---|---|
| Gelatin | 1.0 |
| **Sixth Layer: First Green-Sensitive Emulsion Layer** | |
| Silver iodobromide (silver iodide 4 mol %; average grain size 0.4 micron) | 0.80 |
| Sensitizing dye V | $4.0 \times 10^{-4}$ |
| Sensitizing dye VI | $3.0 \times 10^{-5}$ |
| Sensitizing dye VII | $1.0 \times 10^{-4}$ |
| Polymer coupler E of Comparative Example 5 | 0.40 |
| Coupler C-7 | 0.13 |
| Coupler C-8 | 0.02 |
| Coupler C-4 | 0.04 |
| High-boiling organic solvent HSB-2 | 0.50 |
| Gelatin | 1.3 |
| **Seventh Layer: Second Green-Sensitive Emulsion Layer** | |
| Silver iodobromide (silver iodide 8 mol %; average grain size 0.8 micron) | 0.90 |
| Sensitizing dye V | $2.7 \times 10^{-4}$ |
| Sensitizing dye VI | $1.8 \times 10^{-5}$ |
| Sensitizing dye VII | $7.5 \times 10^{-5}$ |
| Coupler C-6 | 0.095 |
| Coupler C-7 | 0.015 |
| High-boiling organic solvent HSB-2 | 0.20 |
| Gelatin | 1.0 |
| **Eighth Layer: Yellow Filter Layer** | |
| Yellow colloidal silver | 0.08 |
| 2,5-di-t-pentadecylhydroquinone | 0.090 |
| Gelatin | 1.3 |
| **Ninth Layer: First Blue-Sensitive Emulsion Layer** | |
| Silver iodobromide emulsion (silver iodide 5 mol %; average grain size 0.3 micron) | 0.35 |
| Sensitizing dye VIII | $4.4 \times 10^{-4}$ |
| Coupler C-9 | 0.71 |
| Coupler C-4 | 0.07 |
| High-boiling organic solvent HSB-2 | 0.50 |
| Gelatin | 1.5 |
| **Tenth Layer: Second Blue-Sensitive Emulsion Layer** | |
| Silver iodobromide emulsion (silver iodide 7 mol %; average grain size 1.0 micron) | 0.60 |
| Sensitizing dye VIII | $3.0 \times 10^{-4}$ |
| Coupler C-9 | 0.23 |
| High-boiling organic solvent HSB-2 | 0.10 |
| Gelatin | 1.5 |
| **Eleventh Layer: First Protective Layer** | |
| Ultraviolet absorbent U-1 | 0.14 |
| Ultraviolet absorbent U-2 | 0.22 |
| Gelatin | 0.8 |
| **Twelfth Layer: Second Protective Layer** | |
| Silver iodobromide emulsion (silver iodide 2 mol %; average grain size 0.07 micron) | 0.20 |
| Polymethacrylate grains (diameter 1.5 microns) | 0.10 |

-continued

| | |
|---|---|
| Gelatin | 0.5 |

In addition to the above mentioned composition, each layer is further coated with gelatin hardening agent H-1 and a surface active agent.

Then, samples 202 and 206 are prepared following the same procedure as in sample 201, except that the polymer coupler E added to the sixth layer is replaced with polymer couplers F, G and H for comparison, as well as the telomer couplers XXIV and XXVI obtained in the synthesis examples in equal coupler units as shown in FIG. 3.

These samples are exposed imagewise to an A-light source at a color temperature of 4,800° K. through a filter so that maximum exposure might be 20 CMS, and the following color development processing is then carried out at 38° C. Processed strips are measured by the use of a green filter (an interference filter having a maximum transmission at 546 nm) for color densities. The results of photographic performance are summarized in Table 3.

| (Color Development Processing) | |
|---|---|
| Color development | 3 min 15 sec |
| Bleaching | 6 min 30 sec |
| Washing | 2 min 10 sec |
| Fixing | 4 min 20 sec |
| Washing | 3 min 15 sec |
| Stabilization | 1 min 05 sec |

-continued

| | |
|---|---|
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—Ethyl-N—β-hydroxyethylamino)-2-methylaniline sulfate | 4.5 g |
| Water q.s. to (pH 10.0) | 1,000 ml |
| Bleaching Solution | |
| Iron (III) ammonium ethylenediamine-tetraacetate | 100.0 g |
| Disodium ethylenediamine-tetraacetate | 10.0 g |
| Ammonium bromide | 150.0 g |
| Ammonium nitrate | 10.0 g |
| Water q.s. to (pH 6.0) | 1,000 ml |
| Fixer | |
| Disodium ethylenediamine-tetraacetate | 1.0 g |
| Sodium sulfite | 4.0 g |
| Aqueous ammonium thiosulfate solution (70%) | 175.0 ml |
| Sodium bisulfite | 4.6 g |
| Water q.s. to (pH 6.6) | 1,000 ml |
| Stabilizer | |
| Formalin (40%) | 2.0 ml |
| Polyoxyethylene-p-monononyl phenyl ether (average polymerization degree ≃ 10) | 0.3 g |
| Water q.s. to | 1,000 ml |

TABLE 3

| Sample | Coupler | Comonomer | Content of Coupler Unit (wt %) | Average Molecular Weight | Photographic Properties: Relative[1] Sensitivity | Gamma[2] | Color[3] Density |
|---|---|---|---|---|---|---|---|
| 201 (Comparison) | E | BA | 50.8 | 21000 | 0.00 | 0.64 | 2.03 |
| 202 (Comparison) | G | BA | 48.5 | 3600 | −0.04 | 0.63 | 2.09 |
| 203 (This Invention) | XXIV | BA | 51.0 | 2900 | 0.09 | 0.70 | 2.20 |
| 204 (Comparison) | F | BA | 75.3 | 13000 | −0.05 | 0.62 | 1.87 |
| 205 (Comparison) | H | BA | 73.6 | 3800 | −0.08 | 0.62 | 1.94 |
| 206 (This Invention) | XXVI | BA | 75.3 | 2400 | 0.08 | 0.68 | 2.13 |

[1]A relative value of a cologarithm of an exposure adequate to provide a density of fogging + 0.5, when the value of sample 201 is regarded as 0.00.
[2]An inclination of a straight line joining density points of a fogging + 0.2 and a fogging + 1.0.
[3]A magenta density at 1 CMS.

The compositions of the processing solutions used in the respective steps are as follows:

| | |
|---|---|
| Color Developing Solution | |
| Diethylenetriaminepentaacetic acid | 1.0 g |

It is clear from the results of Table 3 that the telomer couplers of the present invention had higher sensitivity, harder gradation and higher color density compared with conventional polymer couplers having about the same coupler unit contents.

Structures of the compounds used in Example 2

U-1

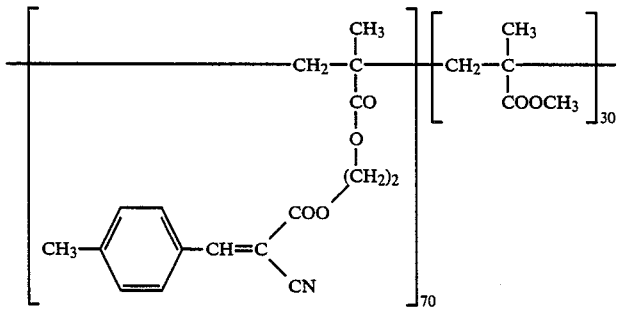

-continued
(Represented by mol %)
U-2
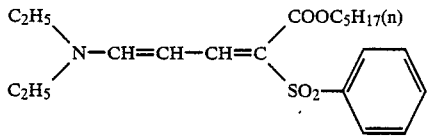
C-1
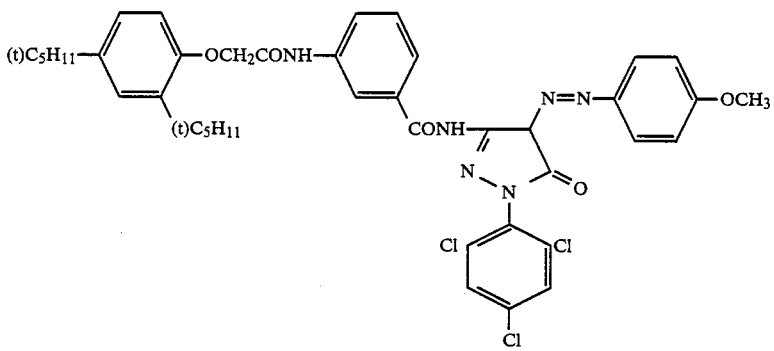
C-2
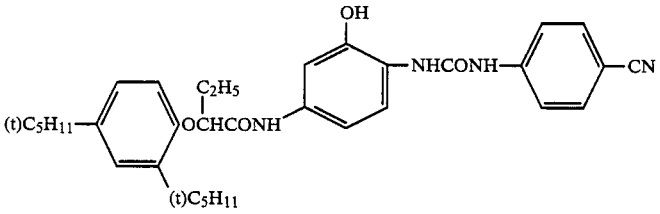
C-3
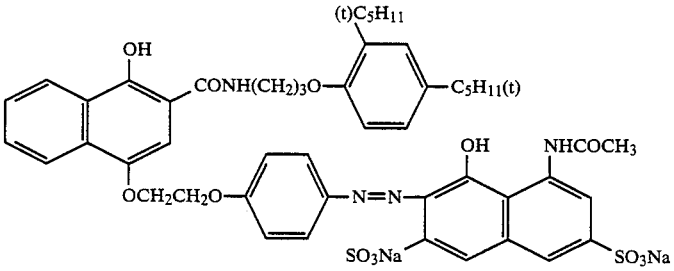
C-4
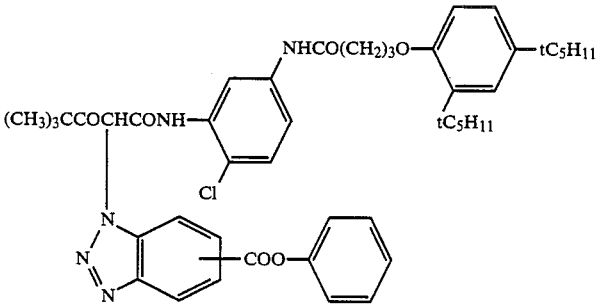
C-5
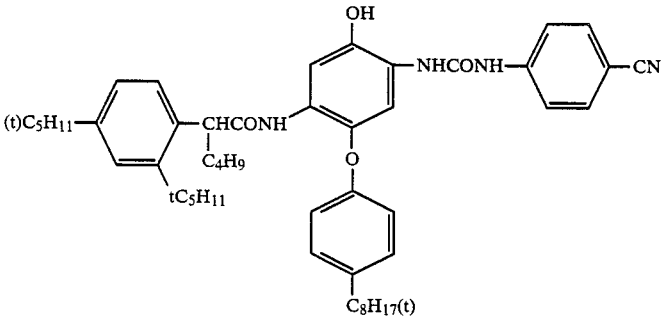

-continued
C-6
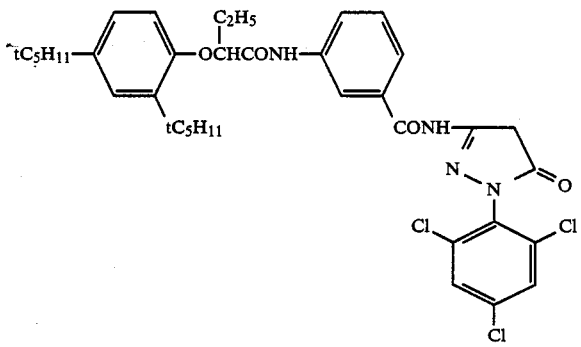
C-7
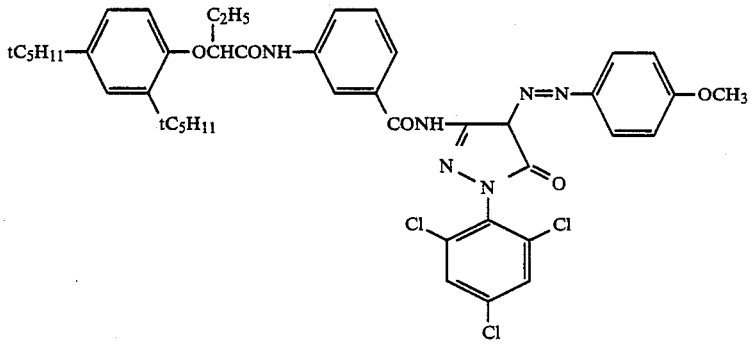
C-8
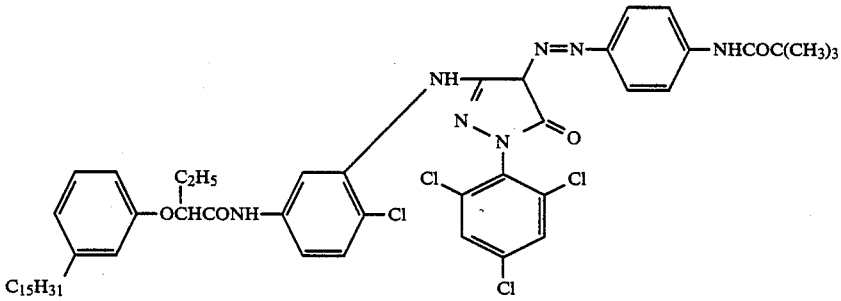
C-9
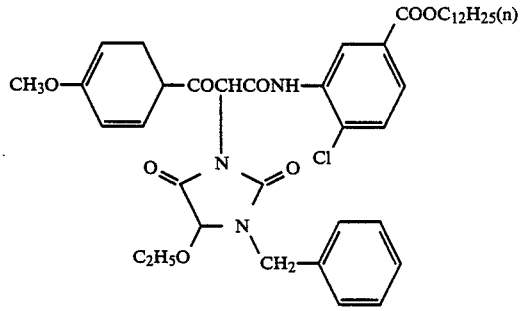
$CH_2{=}CH{-}SO_2{-}CH_2{-}CONH(CH_2)_2NHCO{-}CH_2{-}SO_2{-}CH{=}CH_2$ H-1
Sensitizing dyes
I
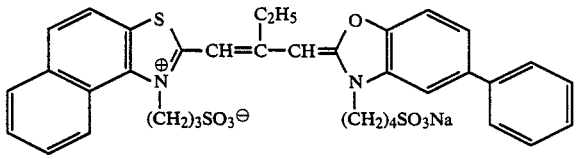

-continued

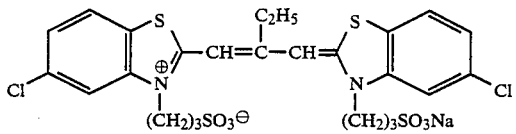

II

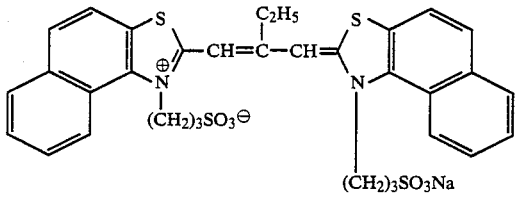

III

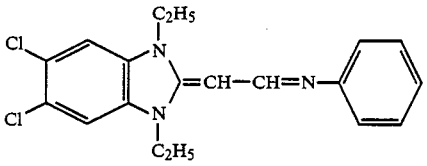

IV

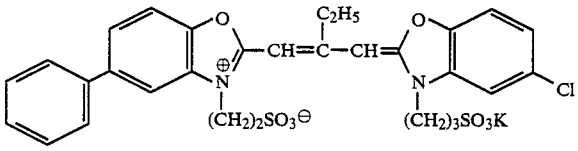

V

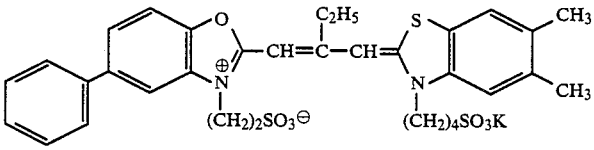

VI

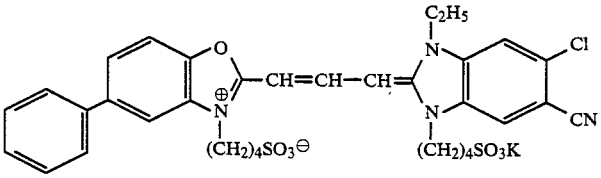

VII

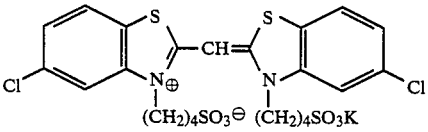

VIII

EXAMPLE 3

A both-side polyethylene laminate paper is coated with an emulsion layer and a protective layer as follows.

One hundred grams of coupler I prepared in the above synthesis example is dissolved by heating at 60° C. in a mixture of 10 cc of dibutyl phthalate and 200 cc of ethyl acetate, and the resulting solution is then mixed with 1,000 ml of an aqueous solution containing 100 g of gelatin and 10 g of sodium dodecylbenzenesulfonate at a temperature of 50° C. It is then agitated by a homogenizer at high speed to prepare a dispersion of the fine coupler grains.

To 1,000 g of this coupler dispersion is added 1,450 g of a chlorobromide emulsion in which silver and iodine are each contained in an amount of 57.8 g and at a concentration of 50 mol %, and the above mentioned laminate paper is coated with the emulsion material such that a coating amount of the coupler might be $8.0\times10^{-4}$ mol/m$^2$.

This layer is further coated by the gelatin protective layer with a dry film thickness of 2 microns in order to prepare sample 501.

To prepare samples 301 to 305, the same procedure is repeated using couplers II, III, IV and VI so that a coating amount (mol/m$^2$) of each coupler and a mixing ratio of the coupler to silver might equal those of sample 301. For comparison, samples 306 to 309 are prepared similarly using couplers (I), (J), (K), and (L) prepared in the above comparative synthesis examples.

These samples are exposed to light through an optical wedge, and color development is then carried out in accordance with the following processing steps:

| | |
|---|---|
| Developing Solution | |
| Trisodium nitrilotriacetate | 2.0 g |
| Benzyl alcohol | 15 ml |
| Diethylene glycol | 10 ml |
| $Na_2SO_3$ | 2.0 g |
| KBr | 0.5 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| $Na_2CO_3$ (monohydrate) | 30 g |
| Water q.s. to (pH 10.1) | 1,000 ml |
| Bleach-Fix Solution | |
| Ammonium thiosulfate (70 wt %) | 150 ml |
| $Na_2SO_3$ | 15 g |
| $NH_4[Fe(EDTA)]$ | 55 g |
| EDTA.2Na | 4 g |
| Water q.s. to (pH 6.9) | 1,000 ml |

| Processing Processes | Temperature | Time |
|---|---|---|
| Developing | 33° C. | 3 min 30 sec |
| Bleach-Fixing | 33° C. | 1 min 30 sec |
| Washing | 28–35° C. | 3 min |
| Drying | | |

The samples which has been processed are measured for cyan densities, and the results are summarized in Table 4.

One hundred grams of the coupler XXXIII prepared in the above synthesis example is dissolved by heating at 60° C. in a mixture of 10 cc of tricresyl phosphate and 200 cc of ethyl acetate, and the resulting solution was then mixed with 1,000 cc of an aqueous solution containing 100 g of gelatin and 10 g of sodium dodecylbenzenesulfonate at temperature of 50° C. It is then agitated by a homogenizer at high speed to prepare a dispersion of the fine coupler grains.

To 1,000 g of this coupler dispersion is added 2,000 g of a chlorobromide emulsion in which silver and bromine are each contained at an amount of 95.5 g and at a concentration of 70 mol %, and the above mentioned laminate paper is coated with the emulsion material such that a coating of the coupler might be $3.5\times10^{-4}$ mol/m$^2$. This layer is further coated with the gelatin protective layer to a dry film thickness of 2 microns in order to prepare sample 401.

In order to prepare samples 402 to 404 the same procedure is repeated using couplers XXXI, XXXV and XXXVI, so that a coating amount (mol/m$^2$) of each coupler and a mixing ratio of coupler to silver might equal those of sample 401. For comparison, samples 405 to 408 are prepared similarly using couplers (M), (N), (O), and (P) prepared in the above comparative synthesis examples.

These samples are exposed to light through an optical wedge, and color development is then carried out as in Example 3.

TABLE 4

| Sample | Coupler | Monomer Coupler | Noncolor-Forming Monomer | Coupler Content (wt %) | Number Average Molecular Weight | Color Density of Cyan (Dmax) | Relative*1 Sensitivity | Remarks |
|---|---|---|---|---|---|---|---|---|
| 301 | I | (1) | BA | 50.6 | 3500 | 3.32 | 0.09 | This Invention |
| 302 | II | (1) | BA | 74.0 | 2200 | 3.05 | 0.06 | " |
| 303 | III | (2) | BA | 50.5 | 3700 | 3.20 | 0.10 | " |
| 304 | IV | (2) | BA/MA | 73.2 | 3900 | 2.85 | 0.07 | " |
| 305 | VI | (4) | MEA | 73.1 | 3200 | 2.80 | 0.06 | " |
| 306 | (I) | (1) | BA | 51.9 | 44000 | 2.39 | 0.00 | Comparison |
| 307 | (J) | (1) | BA | 50.8 | 3700 | 3.07 | −0.05 | " |
| 308 | (K) | (1) | BA | 74.9 | 15600 | 1.37 | −0.03 | " |
| 309 | (L) | (1) | BA | 75.7 | 3500 | 2.75 | −0.08 | " |

*1A relative value of a cologarithm of an exposure enough to provide a density of fogging + 0.5, when the value of sample 306 is regarded as 0.00.

It is clear from the results of Table 4 that the examples containing the telomer couplers of the present invention has excellent color-forming property and high sensitivity.

These samples which has been processed are measured for magenta densities, and the results are summarized in Table 5.

TABLE 5

| Sample | Coupler | Monomer Coupler | Noncolor-Forming Monomer | Coupler Content (wt %) | Number Average Molecular Weight | Magenta Color Density (Dmax) | Relative*1 Sensitivity | Remarks |
|---|---|---|---|---|---|---|---|---|
| 401 | XXXIII | (23) | BA | 50.6 | 1600 | 2.93 | 0.08 | This Invention |
| 402 | XXXI | (23) | BA | 74.8 | 2100 | 2.38 | 0.06 | " |
| 403 | XXXV | (31) | BA | 49.7 | 2700 | 2.71 | 0.04 | " |
| 404 | XXXVI | (32) | MEA | 50.1 | 3400 | 2.43 | 0.04 | " |
| 405 | (M) | (31) | BA | 50.0 | 36000 | 0.83 | −0.04 | Comparison |
| 406 | (N) | (31) | BA | 50.8 | 3500 | 2.40 | −0.10 | " |
| 407 | (O) | (23) | BA | 46.4 | 23000 | 1.75 | 0.00 | " |
| 408 | (P) | (23) | BA | 50.8 | 2500 | 2.55 | −0.05 | " |

*1A relative value of a cologarithm of an exposure enough to provide a density of a fogging + 0.5, when the value of sample 407 is regarded as 0.00.

EXAMPLE 4

A both-side polyethylene laminate paper is coated with an emulsion layer and a protective layer as follows.

It is clear from the results of Table 5 that the examples containing the telomer couplers of the present invention has excellent color-forming property.

Having described the present invention as related to the embodiment, it is intended that the present invention be not limited by any of the details of the description, unless otherwise specified, but rather be construed broadly within its spirit and scope as set out in the accompanying claims.

What we claim is:

1. A silver halide color photographic material comprising at least one non-diffusive lipohilic polymer coupler having a number-average molecular weight of about 1,000 to about 10,000 produced by a polymerization reaction which employs a chain-transfer agent having 8 or more carbon atoms.

2. The silver halide color photographic material as claimed in claim 1, wherein the lipophilic polymer coupler is represented by general formula [P] presented below $$E\text{-}(A)_x\text{-}(B)_y\text{-}X \qquad [P]$$

wherein E represents a monovalent group having 8 or more carbon atoms; A represents a recurring unit derived from an ethylenic unsaturated monomer having a coupler residue capable of forming a dye through coupling with the oxidation product of an aromatic primary amine developing agent; B represents a non-dye forming recurring unit derived from an ethylenic unsaturated monomer capable of being copolymerized; X represents a monovalent group; and x and y each represent the content of the respective recurring units in the polymer coupler, the ratio (x:y) by weight being 10:90 to 100:0.

3. The silver halide color photographic material as claimed in claim 2, wherein A is derived from a monomer represented by general formula [I] presented below

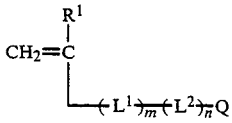

[I]

wherein $R^1$ represents a hydrogen atom, an alkyl group having 1–4 carbon atoms, or a chlorine atom; $L^1$ represents

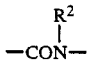

wherein $R^2$ represents a hydrogen atom, an alkyl group having 1–4 carbon atoms, or a substituted alkyl group having 1–6 carbon atoms, —COO—, —NHCO, —OCO—,

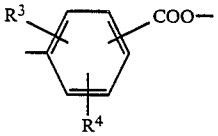

wherein $R^3$ and $R^4$ independently represent a hydrogen atom, hydroxyl group, halogen atom, alkyl group, alkoxyl group, acyloxy group, or aryloxy group,

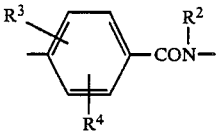

wherein $R^2$, $R^3$, and $R^4$ are as defined above; $L^2$ represents linking groups to connect $L^1$ with Q; m represents a numeral of 0 to 1 and n represents a numeral of 0 to 1; and Q represents a coupler residue capable of forming a dye through coupling with the oxidation product of the aromatic primary amine developing agent.

4. The silver halide color photographic material as claimed in claim 2, wherein E represents a group represented by general formula [XXII] presented below $$E^1\text{—}Y_t \qquad [XXII]$$

wherein $E^1$ represents an alkyl group or aryl group having 8 or more carbon atoms, Y represents —O—, —S—, —SO— or —$SO_2$— and t is 0 or 1.

5. The silver halide color photographic material as claimed in claim 2, wherein X represents a hydrogen atom or halogen atom.

6. The silver halide color photographic material as claimed in claim 3, wherein $L^2$ is represented by the following formula $$[X^1\text{-}(J^1\text{-}X^2)_p\text{-}(J^2\text{-}X^3)_q\text{-}(J^3)_r]_s$$

wherein $J^1$, $J^2$, and $J^3$, which may be the same or different, each represents $$\text{—CO—},\ \text{—}SO_2\text{—},\ \text{—CON}(R^5)\text{—}$$

($R^5$ represents a hydrogen atom, alkyl group having 1–6 carbon atoms, substituted alkyl group having 1–6 carbon atoms), $$\text{—}SO_2N(R^5)\text{—}$$

($R^5$ is as defined above), $$\text{—N}(R^5)\text{—}R^6\text{—}$$

($R^5$ is as defined above, and $R^6$ represents an alkylene group having 1 to about 4 carbon atoms), $$\text{—N}(R^5)\text{—}R^6\text{—N}(R^7)\text{—}$$

($R^5$ and $R^6$ are as defined above, and $R^7$ represents a hydrogen atom, alkyl group having 1–6 carbon atoms, or substituted alkyl group having 1–6 carbon atoms), $$\text{—O—},\ \text{—S—},\ \text{—N}(R^5)\text{—CO—N}(R^7)\text{—}$$

($R^5$ and $R^7$ are as defined above),

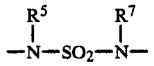

($R^5$ and $R^7$ are as defined above), —COO—, —OCO—,

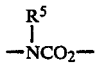

($R^5$ is as defined above), and

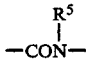

($R^5$ is as defined above); $X^1$, $X^2$, and $X^3$, which may be the same or different, each represent an alkylene group, substituted alkylene group, arylene group, substituted arylene group, aralkylene group, or substituted aralkylene group; and p, q, r, and s each represent 0 and 1.

7. The silver halide color photographic material as claimed in claim 3, wherein, the color coupler residues represented by Q in the above described general formula [I] contain a cyan-forming coupler residue derived from a phenol compound or naphthol compound represented by general formula [II] or general formula [III] or [IV], respectively, presented below, being connected to $(L^1)_m(L^2)_n$ through elimination of a hydrogen atom other than that in the hydroxyl group

[II]

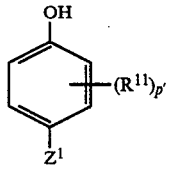

[III]

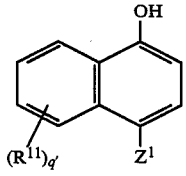

[IV]

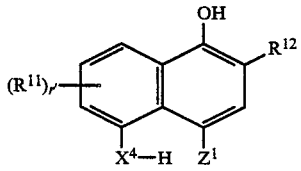

or

[XXV]

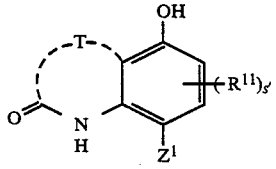

wherein $R^{11}$ represents a possible substituent group on the phenol ring or naphthol ring selected from a halogen atom, hydroxyl group, amino group, carboxyl group, sulfo group, cyano group, aliphatic group, aromatic group, heterocyclic group, carbonamido group, sulfonamido group, carbamoyl group, sulfamoyl group, ureido group, acyloxy group, acyl group, aliphatic oxy group, aliphatic thio group, aliphatic sulfonyl group, aromatic oxy group, aromatic thio group, aromatic sulfonyl group, sulfamoyl amino group, nitro group, and imido group;

$R^{12}$ represents $—CONR^{14}R^{15}$, $—NHCOR^{14}$, $—NHCOOR^{16}$, $—NHSO_2R^{16}$, $—NHCONR^{14}R^{15}$, or $—NHSO_2R^{15}$, wherein $R^{14}$ and $R^{15}$ each represent a hydrogen atom, aliphatic group having 1–30 carbon atoms, aromatic group having 6–30 carbon atoms, or heterocyclic group having 2–30 carbon groups, $R^{16}$ represents an aliphatic group having 1–30 carbon atoms, aromatic group having 6–30 carbon atoms, or heterocyclic group and $R^{14}$ and $R^{15}$ may join each other to form a heterocyclic ring, p' represents an integer of 0 to 3, s' represents an integer of 0 to 2, q' and r' each represent an integer of 0 to 4;

$X^4$ represents an oxygen atom, sulfur atom, or $R^{17}N<$, wherein $R^{17}$ represents a hydrogen atom or monovalent group;

T represents a group of atoms required to form a 5-, 6- or 7-membered ring by connecting with the carbon atoms; and $Z^1$ represents a hydrogen atom or a group capable of splitting-off upon coupling reaction with the oxidation product of an aromatic primary amine developing agent.

8. The silver halide color photographic material as claimed in claim 3, wherein the color coupler residues represented by Q in the above described general formula [I] contain a magenta-forming coupler residue derived from the compound represented by general formula [V], [VI], [VII], [VIII], [IX], [X], or [XI] given below the coupler residue being connected to $(L^1)_m(L^2)_n$ at any of Ar, $Z^2$, and $R^{21}$ to $R^{23}$ (V)

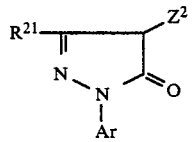

(VI)

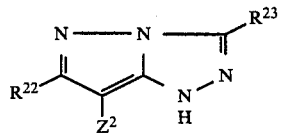

(VII)

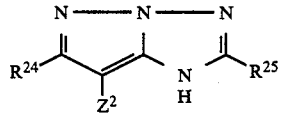

(VIII)

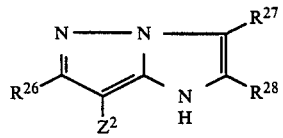

-continued (IX)

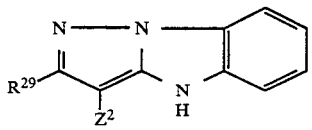

(X)

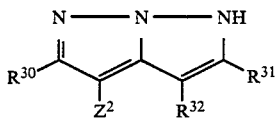

or (XI)

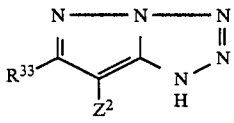

wherein

Ar represents a substituent group of well-known type at 1-position of 2-pirazolin-5- on coupler;

$R^{21}$ represents an unsubstituted or substituted aniline group, acylamino group or ureido group.

$R^{22}$, $R^{23}$, $R^{24}$, $R^{25}$, $R^{26}$, $R^{27}$, $R^{28}$, $R^{29}$, $R^{30}$, $R^{31}$, $R^{32}$, and $R^{33}$ each represent a hydrogen atom, hydroxyl group, unsubstituted or substituted alkyl group, aryl group, heterocyclic group, alkylamino group, acylamino group, anilino group, alkoxycarbonyl group, alkylcarbonyl group, arylcarbonyl group, alkylthio group, arylthio group, carbamoyl group, sulfamoyl group, or sulfonamido group; and $Z^2$ represents a hydrogen atom or a group capable of splitting-off upon coupling reaction with the oxidation product of an aromatic primary amine developing agent.

9. The silver halide color phtographic material as claimed in claim 3, wherein the color coupler residues represented by Q in the above described general formula [I] contain a yellow-forming coupler residue derived from the compound represented by general formula [XII] and [XIII] or [XIV], respectively, given below the coupler residue being connected to $(L^1)_m$ $(L^2)_n$ at the free bond (XII)

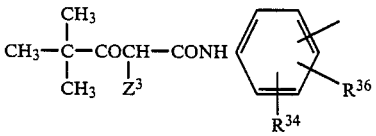

(XIII)

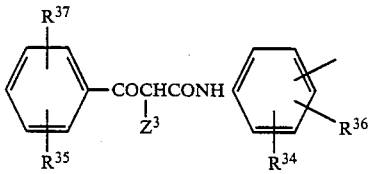

or

-continued (XIV)

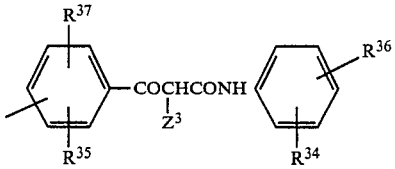

wherein $R^{34}$, $R^{35}$, $R^{36}$, and $R^{37}$ each represent a hydrogen atom or a well-known substituent group of the yellow-forming coupler residue, and $Z^3$ is a hydrogen atom or a group represented by general formula [XV], [XVI], [XVII], or [XVIII] given below

[XV]

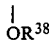

wherein $R^{38}$ is an aryl group or heterocyclic group which may have a substituent group,

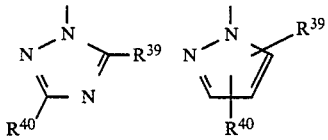

[XVI] [XVII]

wherein $R^{39}$ and $R^{40}$, which may be the same or different, each represent a hydrogen atom, halogen atom, carboxylic ester group, amino group, alkyl group, alkylthio group, alkoxyl group, alkylsulfonyl group, alkylsulfinyl group, carboxylic acid group, sulfonic acid group, unsubstituted or substituted phenyl group, or heterocyclic group, or

[XVIII]

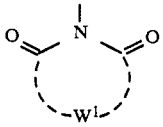

wherein $W^1$ represents a non-metallic atom required to form a 4-, 5-, or 6-membered ring in conjunction with

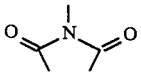

in the general formula.

10. The silver halide color photographic material as claimed in claim 1, wherein the chain-transfer agent is represented by formula E-X, wherein E represents a monovalent group having 8 or more carbon atoms and X represents a monovalent group.

11. The silver halide color photographic material as claimed in claim 2, wherein the content of color-forming moiety in the polymer coupler represented by general formula [I] is 10–95 wt %.

12. The silver halide color photographic material as claimed in claim 2, wherein the content of color-forming moiety in the polymer coupler represented by general formula [I] is 20–90 wt %.

13. The silver halide color photographic material as claimed in claim 1, wherein the number-average molecular weight of the lipophilic polymer coupler is about 1,000 to 5,000.

14. The silver halide color photographic material as claimed in claim 1, wherein the polymer coupler is added in an amount of 0.005 to 0.5 mol based on the coupler monomer to silver halide emulsion layer.

15. The silver halide color photographic material as claimed in claim 1, wherein the polymer coupler is added in amount of 0.01 to 1.0 g/m$^2$ based on the coupler monomer to non-photosensitive layer.

16. The silver halide color photographic material as claimed in claim 10, wherein E is represented by general formula [XXII] presented below $$E'(Y)_T \qquad [XXII]$$

E' represents $C_8H_{17}$—, $C_{10}H_{21}$—, $C_{12}H_{25}$—, $C_{14}H_{29}$—, $C_{15}H_{31}$—, $C_{16}H_{33}$—, $C_{18}H_{37}$—, $C_{20}H_{41}$—, $C_{31}H_{63}$—, $C_8H_{17}OC(=O)CH_2$—, $C_{12}H_{25}OC(=O)CH_2$— $C_{18}H_{37}OC(=O)CH_2$—, $C_2H_5OC(=O)CHC_{12}H_{25}$ $C_{12}H_{25}OC(=O)CH_2CH_2$—, $C_{18}H_{37}OC(=O)CH_2CH_2$—

$C_{16}H_{33}SO_2NHCH_2CH_2$—,

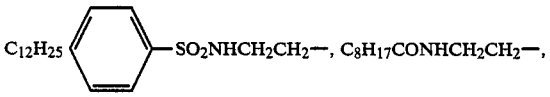

$C_{13}H_{27}CONHCH_2CH_2$—, $C_{15}H_{31}CONHCH_2CH_2$, $C_{17}H_{35}CONHCH_2CH_2$—,

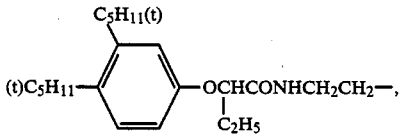

$CH_3CON(C_{12}H_{25})CH_2CH_2$—, $C_{12}H_{25}NHCH_2CH_2$—, $C_{16}H_{33}NHCH_2CH_2$—, $C_{12}H_{25}NHCOCH_2$—,

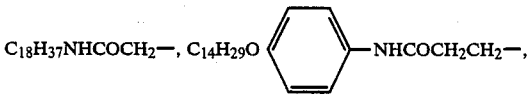

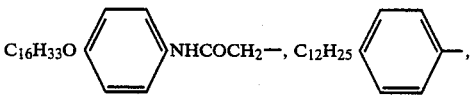

-continued

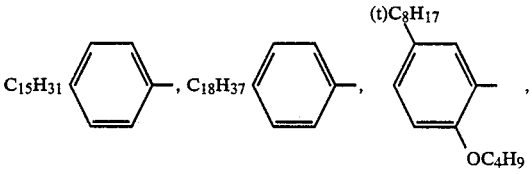

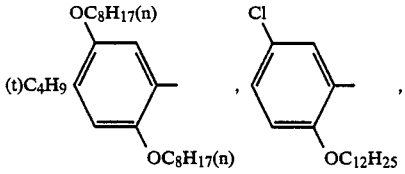

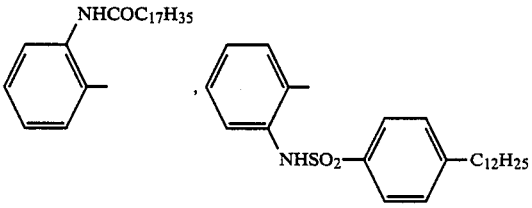

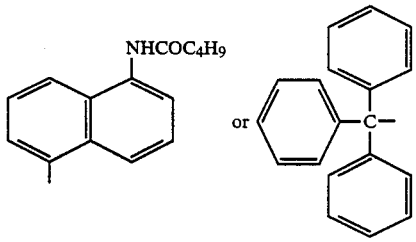

Y represents —O—, —S—, —SO—, or —$SO_2$— and t is 0 or 1 and wherein X represents a hydrogen atom or a halogen atom.

17. The silver halide color photographic material as claimed in claim 1, wherein the chain transfer agent is $C_8H_{17}SH$, $C_{10}H_{21}SH$, $C_{12}H_{25}SH$, $C_{14}H_{29}SH$, $C_{15}H_{31}SH$, $C_{16}H_{33}SH$, $C_{18}H_{37}SH$, $C_{20}H_{41}SH$, $C_{31}H_{63}SH$, $C_8H_{17}OC(=O)CH_2SH$, $C_{12}H_{25}OC(=O)CH_2SH$, $C_{18}H_{37}OC(=O)CH_2SH$, $C_2H_5OC(=O)CH(SH)C_{12}H_{25}$, $C_{12}H_{25}OC(=O)CH_2CH_2SH$, $C_{18}H_{37}OC(=O)CH_2CH_2SH$, $C_{16}H_{33}SO_2NHCH_2CH_2SH$,

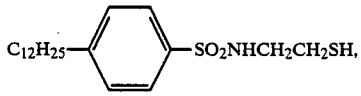

$C_8H_{17}CONHCH_2CH_2SH$, $C_{13}H_{27}CONHCH_2CH_2SH$, $C_{15}H_{31}CONHCH_2CH_2SH$, $C_{17}H_{35}CONHCH_2CH_2SH$,

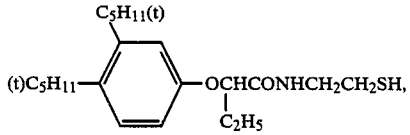

-continued $CH_3CON(C_{12}H_{25})CH_2CH_2SH$, $C_{12}H_{25}NHCH_2CH_2SH$, $C_{16}H_{33}NHCH_2CH_2SH$, $C_{12}H_{25}NHCOCH_2SH$, $C_{18}H_{37}NHCOCH_2SH$,

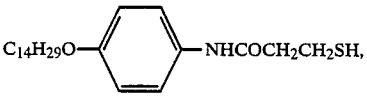

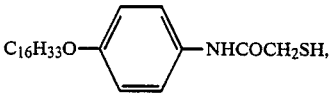

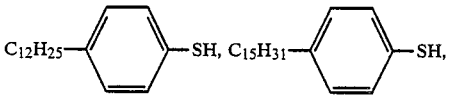

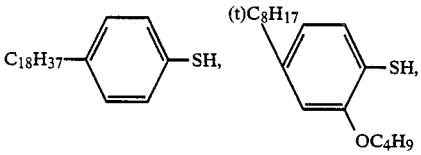

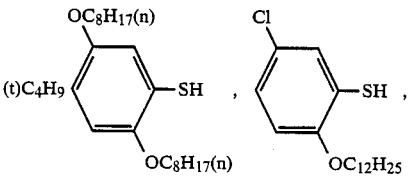

-continued

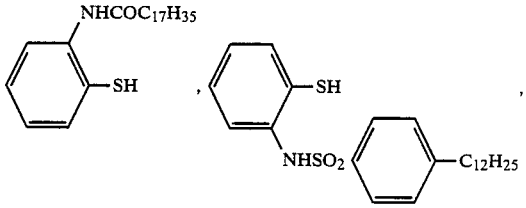

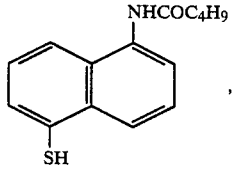

$C_{10}H_{21}CH(CH_3)OH$, $C_6H_{13}CH(C_3H_7)OH$,

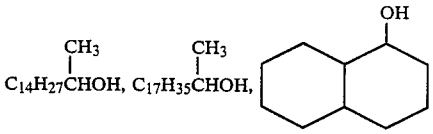

$C_{14}H_{27}CH(CH_3)OH$, $C_{17}H_{35}CH(CH_3)OH$, $BrCH_2COOC_{12}H_{25}$, $ClCH_2COOC_{12}H_{25}$, $ICH_2COOC_{12}H_{25}$, $BrCH_2COOC_{16}H_{33}$, $ClCH_2COOC_{18}H_{37}$, $ICH_2COOC_{18}H_{37}$, $Br_2CHCOOC_{12}H_{25}$, $Cl_3CCOOC_{16}H_{33}$ or

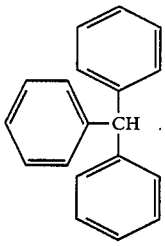

18. The silver halide color photographic material as claimed in claim 1, wherein the lipophilic polymer coupler produced comprises about 0.1 to about 20 weight % of the chain transfer agent.

19. The silver halide color photographic material as claimed in claim 1, wherein the chain transfer agent is present in an amount of about 2–100 mol % based on the coupler.

* * * * *